US011549312B2

(12) United States Patent
Shotwell

(10) Patent No.: US 11,549,312 B2
(45) **Date of Patent: *Jan. 10, 2023**

(54) REAMER WITH CUTTING INSERTS FOR USE IN DRILLING OPERATIONS

(71) Applicant: Chengdu Best Diamomd Bit Co., Ltd, Chengdu (CN)

(72) Inventor: Duane Shotwell, Conroe, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/686,874

(22) Filed: Nov. 18, 2019

(65) Prior Publication Data

US 2020/0256131 A1 Aug. 13, 2020

Related U.S. Application Data

(63) Continuation of application No. 15/387,875, filed on Dec. 22, 2016, now Pat. No. 10,502,000, which is a continuation-in-part of application No. 14/533,981, filed on Nov. 5, 2014, now Pat. No. 10,000,973, application No. 16/686,874, filed on Nov. 18, 2019, which is a continuation of application No. 16/413,499, filed on May 15, 2019.

(51) Int. Cl.

| | |
|---|---|
| ***E21B 10/26*** | (2006.01) |
| ***E21B 10/62*** | (2006.01) |
| *E21B 7/28* | (2006.01) |
| *E21B 10/44* | (2006.01) |
| *E21B 10/43* | (2006.01) |
| *E21B 10/56* | (2006.01) |
| *E21B 7/128* | (2006.01) |

(52) U.S. Cl.
CPC ..... *E21B 10/26* (2013.01); *E21B 10/62* (2013.01); *E21B 7/128* (2013.01); *E21B 7/28* (2013.01); *E21B 10/43* (2013.01); *E21B 10/44* (2013.01); *E21B 10/56* (2013.01)

(58) Field of Classification Search
CPC ..... E21B 10/5673; E21B 10/26; E21B 10/62
See application file for complete search history.

(56) References Cited

U.S. PATENT DOCUMENTS

| | | | | |
|---|---|---|---|---|
| 10,502,000 | B2 * | 12/2019 | Shotwell | E21B 10/62 |
| 2011/0259642 | A1 * | 10/2011 | DiGiovanni | E21B 10/567 175/57 |
| 2013/0341097 | A1 * | 12/2013 | Stowe, II | E21B 10/43 175/57 |
| 2014/0116788 | A1 * | 5/2014 | Patel | E21B 10/573 175/428 |

* cited by examiner

*Primary Examiner* — Kristyn A Hall
(74) *Attorney, Agent, or Firm* — Patrick Reilly

(57) ABSTRACT

The invention relates to reamers used in downhole oil well drilling operations, particularly in reaming while drilling applications. Presented is a reamer having an interior channel which runs along an elongate axis of the entire body of the reamer, wherein there are openings along both ends of the reamer, exposing the interior channel. Additionally presented in the reamer are a plurality of paths extending parallel to the interior channel along the exterior of the body of the reamer, and running in a helical pattern along the entirety of the exterior of the body of the reamer. Disposed within the helical paths are a plurality of cutting inserts, which cutting inserts are enabled to provides a uniform cutting surface against a well bore, which preferably improves cutting action and reduces strain on the reamer.

22 Claims, 28 Drawing Sheets

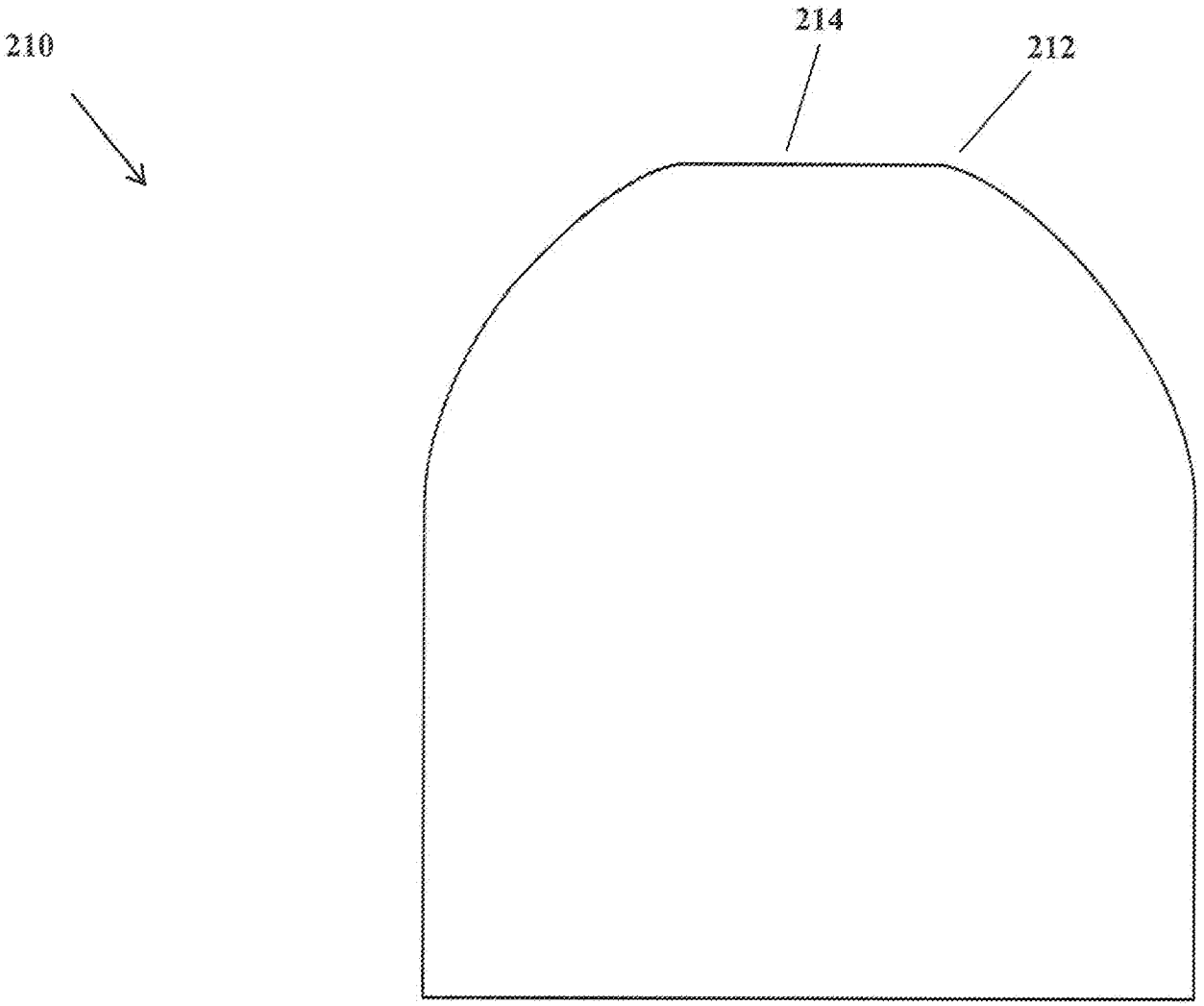
FIGURE 2A – PRIOR ART

REAMER WITH CUTTING INSERTS FOR USE IN DRILLING OPERATIONS

CO-PENDING PATENT APPLICATIONS

This Nonprovisional Patent Application is a Continuation Application to Nonprovisional patent application Ser. No. 15/387,875 as filed on Dec. 22, 2016 by Inventor Duane Shotwell and titled Reamer Cutting Insert for Use in Drilling Operations.

This Nonprovisional Patent Application is a Continuation Application to Nonprovisional patent application Ser. No. 16/413,499 as filed on May 15, 2019 by Inventor Duane Shotwell and titled Reamer Cutting Insert for Use in Drilling Operations.

FIELD OF THE INVENTION

The method of the present invention relates to a drilling apparatus for use in the oil industry. More particularly, the present invention relates to a reamer for use in oil well drilling operations.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions. Wellbore reamers are known in the field of oil well drilling operations, and are used to open wellbores to allow for smooth operation of a drilling string. For example, U.S. Pat. No. 8,607,900 to Smith discloses a bi-directional reamer. Similarly, European Patent Application No. EP1811124 by Bassal, et al. discloses a similar type of bidirectional reamer.

While they are useful tools, these types of reamers have maintenance requirements that can result in increased costs in drilling. Wear and tear on the cutting inserts or the tool body can result in effective failure of the tool, which can then require pulling the drill string to replace the reamer. Some wear of the cutting bits on a reamer is expected, but the rate of wear can be exacerbated by the configuration of the tool. For example, the configuration of the blades on a reamer may direct drilling fluid away from, rather than over, the cutting inserts, resulting in excessive wear due to heating. Thus, it is desirable to provide improved fluid flow over the cutting inserts of a reaming tool by improving the placement and positioning of the cutting inserts relative to a body of the reaming tool, and the angle at which the cutting inserts of the reaming tool interact with the wellbore in a drilling operation.

Additionally, current reaming-while-drilling tools utilize flat cap tungsten carbide inserts as the primary cutting inserts on the cylindrical outer diameter. It is desirable to provide an improved cutting insert design and material formulation to provide such a tool with greater efficiency. Similarly, current reamer designs place the tungsten carbide cutting inserts in simple rows and columns, which does not provide uniform distribution of the carbide against the engaged borehole wall. It is desirable to provide a reamer that aligns the cutting inserts so that there is more uniform coverage of the blade width, for example by providing cutting inserts positioned in close proximity to one another within a helical pattern. It is desirable to provide a reamer with an improved blade design, over currently used helical blades for purposes of improving fluid flow over the cutting inserts.

There is therefore a long-felt need to provide a reaming tool with increased efficiencies in cutting insert size, composition, placement, and design.

SUMMARY OF THE INVENTION

Towards these objects and other objects that will be made obvious in light of the present disclosure, a reaming tool is presented which implements a unique blade design and preferably improved cutting insert design (hereinafter "the invented reamer"). A first preferred embodiment of the invented reaming tool preferably comprises a tool body with a plurality of cutting inserts extending outward from the tool body. For drilling operations, the tool body comprises an annular opening having a top open end and a bottom open end, axisymmetric about an elongate axis, through which drilling fluid is pumped downhole, through the drillstring to the drill bit. Drilling fluid returns uphole along the exterior of the drillstring, providing lubrication and cooling in drilling operations.

The invented reamer additionally preferably comprises two or more invented cutting inserts, wherein the invented cutting inserts are disposed along the exterior of the annular body. The cutting inserts of the present invention may rise from either end of the reamer in along and within a helical pattern, forming a helical section parallel to the annular body between the tapered ends, wherein the helically positioned cutting inserts lay in very close proximity to one another, preferably spaced in such a way that the view of the cutting inserts is uninterrupted along an axial view of the reaming tool. In one preferred embodiment of the present invention, the helical portion of the cutting inserts comprise tungsten carbide inserts of a unique design. The cutting inserts are preferably approximately 25%-50% larger in diameter than standard inserts and provide a flat-topped design with an interior channel and an opening disposed on a top side of a sidewall of the cutting insert rather than, as with inserts currently in use, having partially rounded, solid tops. Additionally, the total size and quantity of the cutting inserts of the certain alternate preferred embodiments of the invented reamer on which the invented inserts are mounted are selected in view of the blade width of the invented reamer, external diameter of each invented insert, and a selected distance between placements of invented cutting insert to their neighboring inserts. More particularly, the severity of the geologic environment that the invented reamer is engaged with is taken into account in the selected placement pattern, size, and number of invented inserts included in the design of certain applications of specific alternate preferred embodiments of the invented reamer. The placement of the invented cutting inserts in the drilling direction may optionally be distributed in accordance with a helical or spiral geometry along the exterior of yet additional alternate preferred embodiments of the invented reamer. The placement of the invented cutting inserts may result in a more uniform cutting profile distribution of the carbide embodiments of the invented cutters against the borehole wall and also provides an additional cutting edge length against a surface of a borehole wall in drilling operations.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

These, and further features of the invention, may be better understood with reference to the accompanying specification and drawings depicting the preferred embodiment, in which:

FIG. 2A is a schematic side view of a prior art tungsten carbide cutting insert of the reamer of FIG. 1;

DETAILED DESCRIPTION

Figure 1:
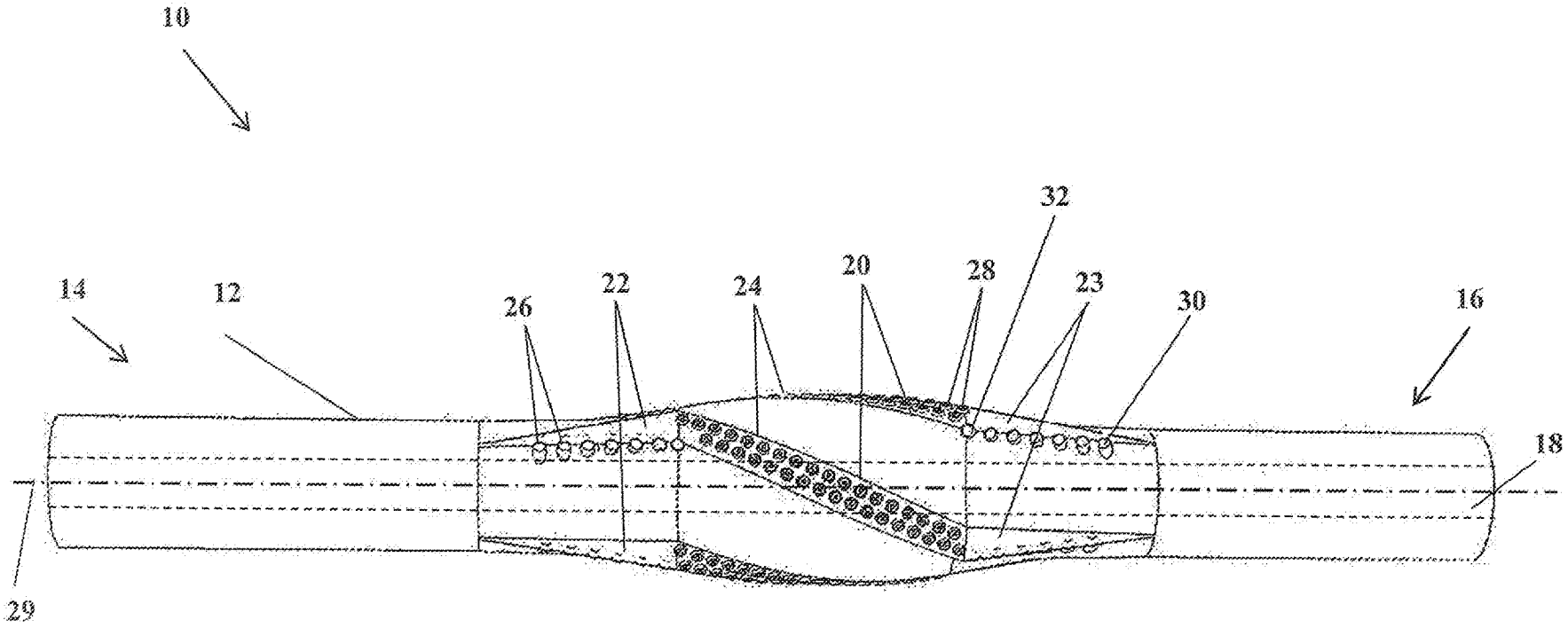
FIG. 1 is a side view of one embodiment of the present invention comprising a reamer and a first preferred embodiment of the invented cutting insert.

Referring now to FIG. 1, FIG. 1 shows a reamer 10 of the method of the present invention. The reamer 10 comprises a reamer body 12 having a first end 14, a second end 16, an interior channel 18, and a plurality of cutting blades 20 positioned on a helical section 24. First end 14 of the reamer 10 is positioned "uphole" within a borehole (not shown) that is, closer to the surface via the example borehole as known in earth drilling operations than the second end 16, which is positioned "downhole," i.e. further from the surface in the surrounding borehole. Drilling fluid is pumped downhole through the interior of the drilling string, flows through the reamer 10, through the interior channel 18, and exits the reamer 10 at the second end 16. As it returns uphole, the drilling fluid flows over the exterior of the reamer 10, providing lubrication and cooling, as well as cleaning for the cutting blades 20.

Each of the cutting blades 20 comprises a first linear tapered section 22 and a second linear tapered section 23 which rise from the reamer body 12 to a desired cutting radius, and a helical section 24 disposed between the tapered sections 22 & 23. The desired cutting radius/helical section 24 is preferably within the range of ⅛ inch to ½ inch smaller than the desired diameter of borehole into which the reamer 10 is inserted. One or more prior art cutting inserts 26 are positioned along and coupled with the reamer 10 at the helical section 24. One or more, or all, of the prior art cutting inserts 26 preferably comprise tungsten carbide and/or any suitable material known in the art in combination or in singularity.

A plurality of alternate prior art polycrystalline diamond (hereinafter "PDC") cutting inserts 30, are positioned along and coupled with the reamer 10 at the first and second linear tapered sections 22 & 23 of the reamer 10. One or more of a plurality of invented cutting inserts 28 are arrayed on the helical sections 24 about a central elongate axis 29. One or more, or all, of the invented cutting inserts 28 preferably comprise tungsten carbide and/or any suitable material known in the art in combination or in singularity.

The central elongate axis 29 extends through the interior channel 18 of the reamer 10, through the first end 14 and the second end 16 of the reamer body 12, describing a central point from which prior art cutting inserts 26 & 30, and the plurality of invented cutting inserts 28 extend. It is understood that the prior art cutting inserts 26 & 30 may additionally or optionally be arranged in a curved pattern, rather than linear pattern, or in any suitable cutting arrangement pattern known in the art. Alternatively or additionally, one or more inserts 26 & 28 may be composed of any other suitable material composition.

The linear form of the first and second linear tapered sections 22 & 23 provide improved cleaning and cooling of the cutting inserts arrayed thereon, because circulating fluid is forced directly over these cutting inserts. Those of skill in the art will recognize that the symmetrical arrangement of the prior art cutting inserts 26 & 30 and the invented cutting inserts 28 will allow the reamer 10 to ream a borehole regardless of whether the reamer 10 is moving uphole or downhole.

Referring now generally to the Figures and particularly FIG. 2A, a prior art tungsten carbide cutting insert 26 is shown. The prior art inserts 26 characteristically provide angled, tapered or radiused sides 200 leading to a flat top 202.

Figure 2C:
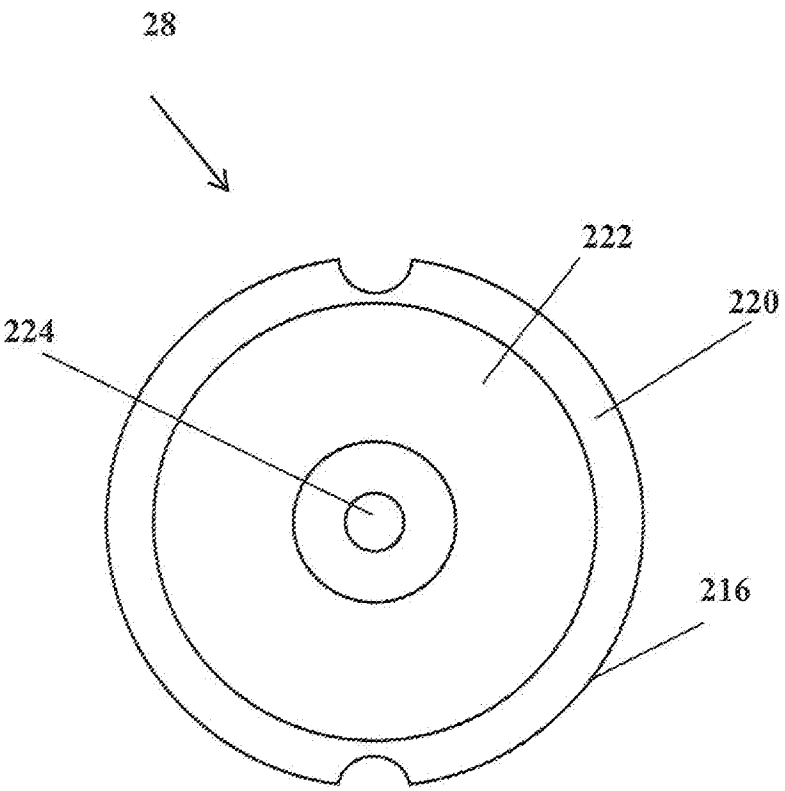
FIG. 2C is a schematic top view of the invented cutting insert of FIG. 2B.
Figure 2B:
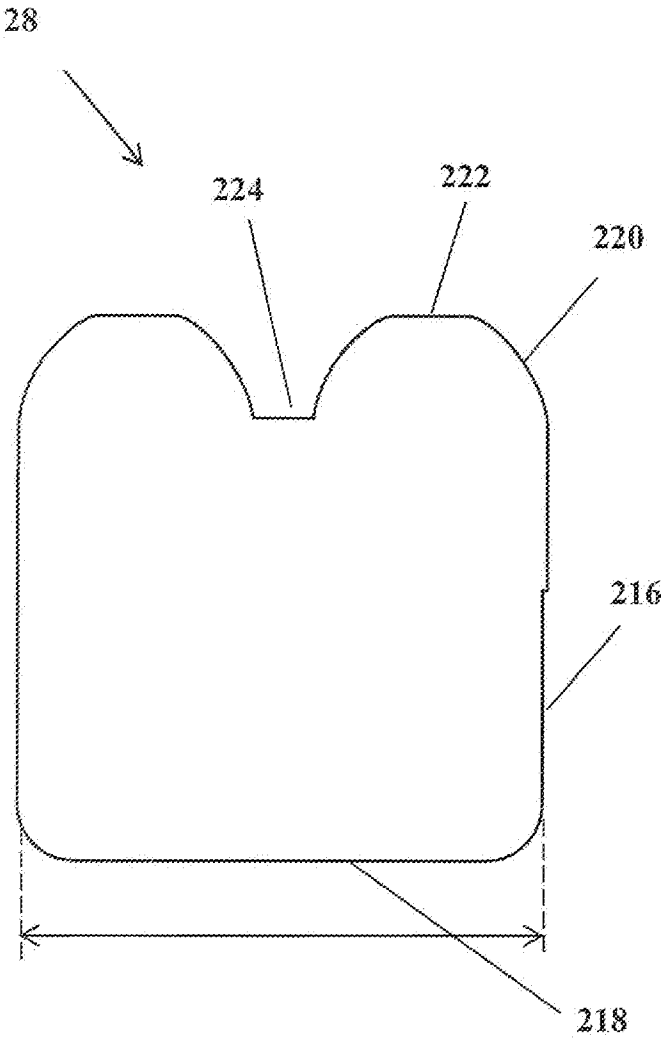
FIG. 2B is a schematic cross-sectional side view of the invented cutting insert of the present invention of FIG. 1.

Referring now generally to the Figures and particularly FIG. 2B and FIG. 2C, FIG. 2B is a side elevation view of the invented cutting insert 28. The invented insert 28 optionally includes an angled, tapered or radiused inner insert sidewall 204 leading to a flat top surface 206, and additionally provides a central insert depression 208 in the center of each of the alternate preferred embodiment of the invented cutting insert 28.

This depressed design of the method of the present invention allows the cumulative cutting lengths of the invented cutting inserts 28 to be larger than the total cutting length of prior art cutting inserts 26. Furthermore, the central insert depression 208 in the invented cutting inserts 28 makes the invented cutting inserts 28 less likely to break and provides a greater surface area for interaction with the wellbore. A sidewall 210 of the invented cutting insert 28 extends from an attachment surface 212 (hereinafter, "bottom surface" 212) to the optional inner insert sidewall 204. A length dimension of the sidewall 210 extends along a first diameter D1 of the insert bottom surface 212.

It is understood that in certain alternate preferred embodiments of the present invention that the optional inner insert sidewall 204 is altered by wear incurred by the invented cutting insert 28 resulting from engagement of the outer top edge 214 with the borehole. Alternatively or additionally, the invented cutting insert 28 may be originally formed such that the sidewall 210 meets directly the top surface 206 without intermediation and that the optional inner insert sidewall 204 is subsequently formed by wear incurred by the invented cutting insert 28 resulting from engagement of the outer top edge 214 with the borehole.

Referring now generally to the Figures and particularly FIG. 2B and FIG. 2C, FIG. 2C is a top plan view of the invented cutting insert 28. The outer top edge 214 is defined at a line where the flat top surface 206 meets the inner insert sidewall 204. An inner top edge 216 is formed at a line where the flat top surface 206 meets a depression wall 218. The depression wall 218 extends from the top surface 206 to a depression bottom surface 220. It is understood that the depression wall 218 and the depression bottom surface 220 define the depression 208.

Figure 3:
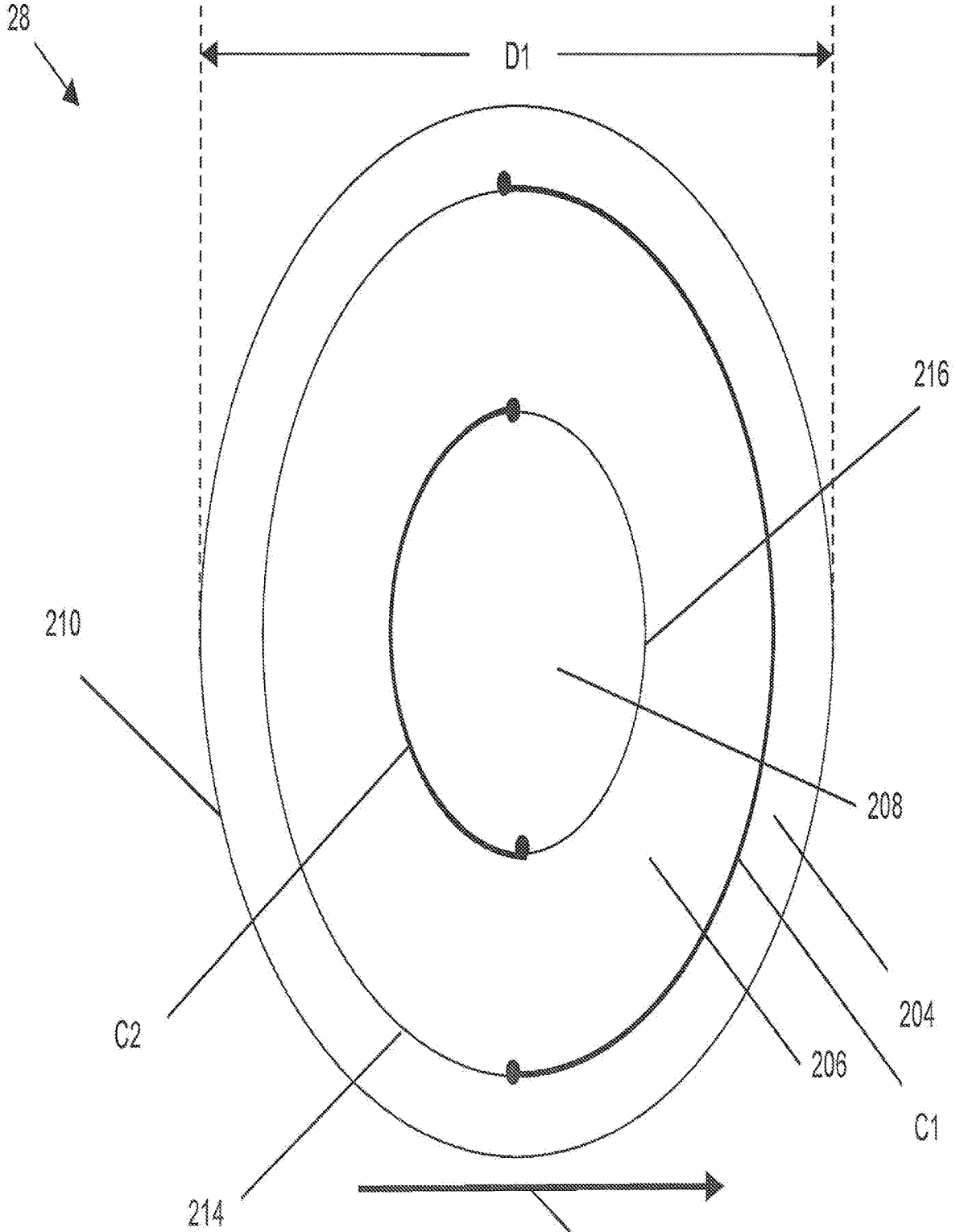
FIG. 3 is a schematic top view of the invented cutting insert of FIG. 2B and illustrating the cutting surfaces of the insert while the reamer is in motion.

Referring now generally to the Figures and particularly FIG. 3, the invented cutting inserts 28 have an outer diameter of the bottom surface D1 (hereinafter, "first diameter"), the outer top edge 214, and the inner top edge 216. When the reamer 10 is in rotational motion and traversing in the indicated angular direction 300, an outer cutting edge C1 of the outer top edge 214 and an inner cutting edge C2 of the inner top edge 216 make contact with the sides of the borehole. In other words, the outer cutting edge C1 of the outer top edge 214 is defined as that portion of the outer top edge 214 that makes contact with the borehole and cuts away rock and components of the borehole as the reamer 10 is rotated within the borehole and about the central elongate axis 29; the inner cutting edge C2 of the inner top edge 216 is defined as that portion of the inner top edge 216 that makes contact with the borehole and cuts away rock and components of the borehole as the reamer 10 is rotated within the borehole and about the central elongate axis 29. As the invented cutting insert 28 engages with the borehole wall (not shown) the top surface 206 will tend to wear substantively evenly and the outer top edge 214 and the inner top edge 216 will each generally maintain their geometric shape. It is understood that when the depression wall 218 is tapered toward the central insert axis 29 as the depression wall 218 approaches the depression bottom surface 220, the dimension of the inner top edge 216 will reduce as the top surface 206 is relieved by engagement with the borehole wall (not shown).

Figure 4A:
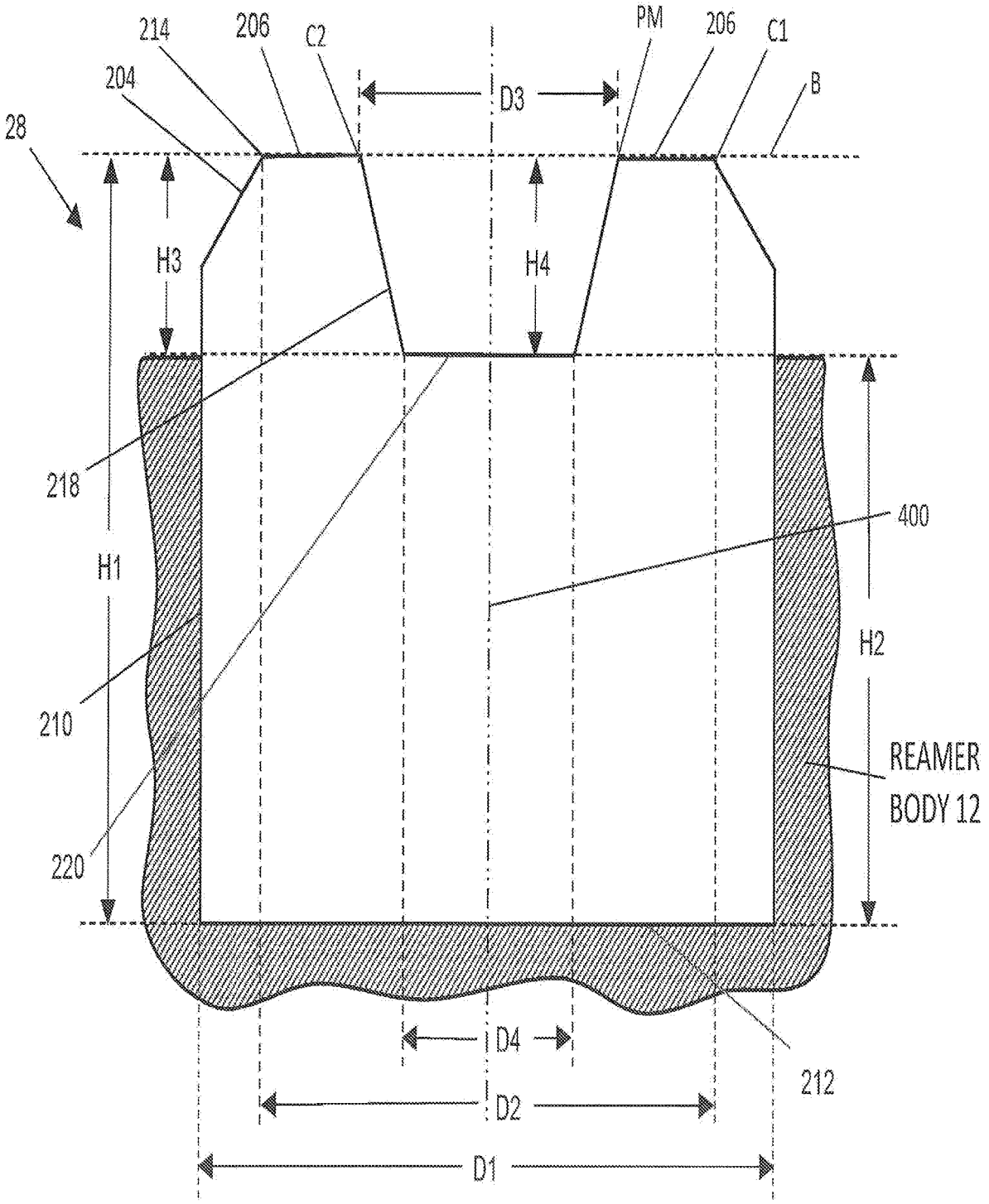
FIG. 4A is a side view of a cutting insert of an alternate embodiment of the present invention of FIG. 1 wherein a depression extends below a top surface of the alternate embodiment of the invented insert and not below the outer surface of the reamer of FIG. 1.

Regarding FIG. 4A, FIG. 4A is a side view of a preferred embodiment of the invented cutting insert 28 showing a plurality of dimensions according to which the cutting insert 28 may preferably be built.

A first height H1 of a sidewall 210 dimension of the invented cutting insert 28 concentric to a cutting insert central axis 400 extending between the top surface 206 of the invented cutting insert 28 and the bottom surface 212 of the invented cutting insert 28, wherein the first height H1 is preferably within the range of from 0.01 inch to 5.0 inches or greater and more preferably within the range of 1⅜ inches to 2¼ inches. A second height H2 shows a length of the invented cutting insert 28 which extends into the body 12 of the reamer 10, and is preferably measured along the cutting insert central axis 400 preferably within the range of 1.0 inch to 2.0 inches in certain alternate preferred embodiments of the method of the present invention. A third height H3 shows a length of the invented cutting insert 28 which extends outward from the body 12 of the reamer 10 concentric to the cutting insert central axis 400 to the top surface 206 of the invented cutting insert 28 which preferably interacts with and cuts wellbore materials along a boring plane P. The boring plane P is preferably normal to the cutting insert central axis 400. The measurement of third height H3 extending along the cutting insert central axis 400 between the top surface 206 and the bottom surface 212 of the invented cutting insert 28 is equal to the second height H2 subtracted from the first height H1 (H3=H1−H2), and is preferably within the range of ⅛ inch to ¾ inch in certain alternate preferred embodiments of the method of the present invention. The second height H2 is preferably larger than the third height H3, such that more of the invented cutting insert 28 is sunk into the body 12 of the reamer 10 than extends therefrom.

Additionally shown is a fourth height H4 of the depression 208 along the cutting insert central axis 400 of the invented cutting insert 28. The fourth height H4 extends from the top surface 206 to the depression bottom surface 220.

The value of the fourth height H4 is preferably equal to or greater than the value of the third height H3, but the depression 208 may optionally extend into the body 12 of the reamer 10. The specific dimension of the fourth height H4 of the depression 208 in various preferred embodiments of the invented cutting insert 28 is as much or as little as deemed desirable, necessary or optimal by a user and/or a manufacturer. Alternatively, the depression 208 may optionally extend entirely through the invented cutting insert 28, such that the depression 208 forms a tapered or cylindrical hole through the entire interior invented cutting insert 28 height H1 along the cutting insert central axis 400, as shown in FIG. 4D and accompanying text.

Additionally shown are a plurality of diameters D1-D5 of elements of the invented cutting insert 28. The second diameter D2 of the invented cutting insert 28 describes a diameter of the invented cutting insert 28 where the outer top edge 214 of the invented cutting insert 28 is formed, and is preferably runs normal to the cutting insert central axis 400 within the range of ⅜ inch to 1 inch. The first height H1 is preferably within the range of 1 times the second diameter D2 to 1½ times the second diameter D2. Furthermore, the second height H2 is preferably within the range of 1 times the second diameter D2 to 1½ times the second diameter D2, depending upon the total value of the first height H1. A third diameter D3 of the depression 208 describes the diameter of the depression 208 along the top surface 206 of the invented cutting insert 28 where the inner top edge 216 of the invented cutting insert 28 is formed, wherein the top surface 206 of the invented cutting insert 28 is preferably flush with the boring plane P. The surface area of the top surface 206 forms the top cutting surface 206 of the invented cutting insert 28. Both of the cutting edges C1 and C2 reside within the top surface 206, and only cutting edges C1 and C2 actually interact with and cut wellbore materials.

A depression perimeter PM is also shown, wherein the depression perimeter PM describes an upper, outer edge of the depression 208. It is understood that the perimeter PM of the depression 208 is the boundary of the depression 208 within the invented cutting insert 28 and may optionally, but does not necessarily, comprise the inner cutting edge C2 or portions of the inner cutting edge C2.

The measurement of third diameter D3 of the depression 208 normal to the cutting insert central axis 400 is preferably between ⅓ and ⅔ of the first diameter D1 of the invented cutting insert 28. A fourth diameter D4 describes a bottom of the depression 208, and is smaller than the third diameter D3 of the top of the depression 208, such that the depression 208 is tapered, but may optionally be equal to the third diameter D3 of the top of the depression 208, such that the depression 208 is substantively cylindrical in shape.

Figure 4B:
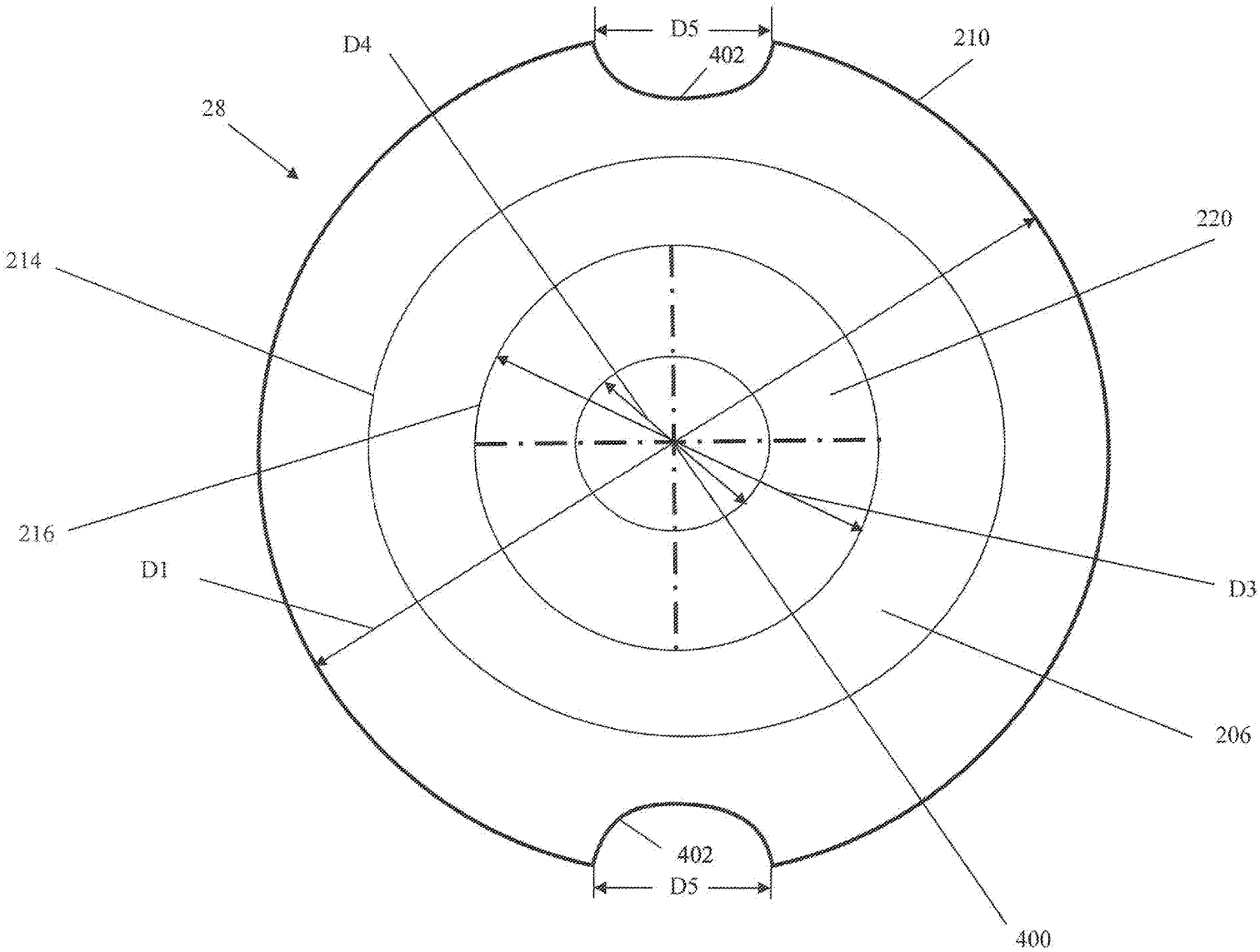
FIG. 4B is a top view of the alternate invented cutting insert of the present invention of FIG. 4A.

Regarding FIG. 4B, FIG. 4B is a top view of the invented cutting insert 28, showing the top surface 206, the perimeter PM of the depression 208, the first diameter D1 of the sidewall 210, the second diameter D2 of the outer top edge 214, the third diameter D3 of the top of the depression 208 and the inner top edge 216, the fourth diameter D4 of the bottom of the depression 208, and a fifth diameter D5 describing the diameter of one or more indents 402 in the invented cutting insert 28. The indents 402 of the invented cutting insert 28 define weep slots for use during the process whereby the invented cutting inserts 28 are mounted in and/or on the reamer 10 by means of brazing, and thus the diameter D4 of the indents 402 may be as large or as small as is deemed necessary by a manufacturer of the reamer 10. Additionally shown are the sidewall 210 of the invented cutting insert 28 and the cutting insert central axis 400, to which each of the diameters D1-D5 are preferably normal.

Figure 4C:
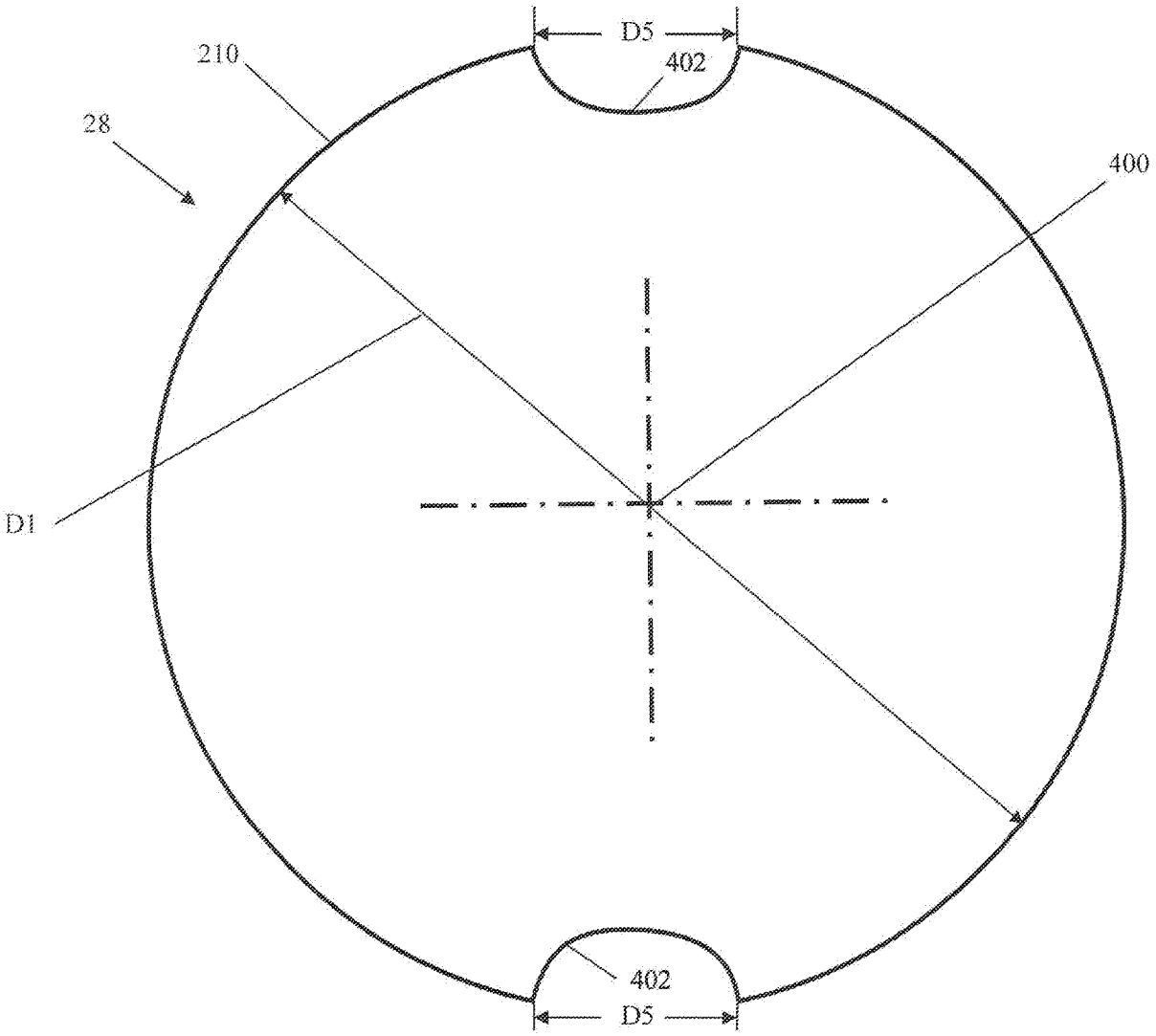
FIG. 4C is a bottom view of the alternate invented cutting insert of the present invention of FIG. 4A.
Figure 4D:
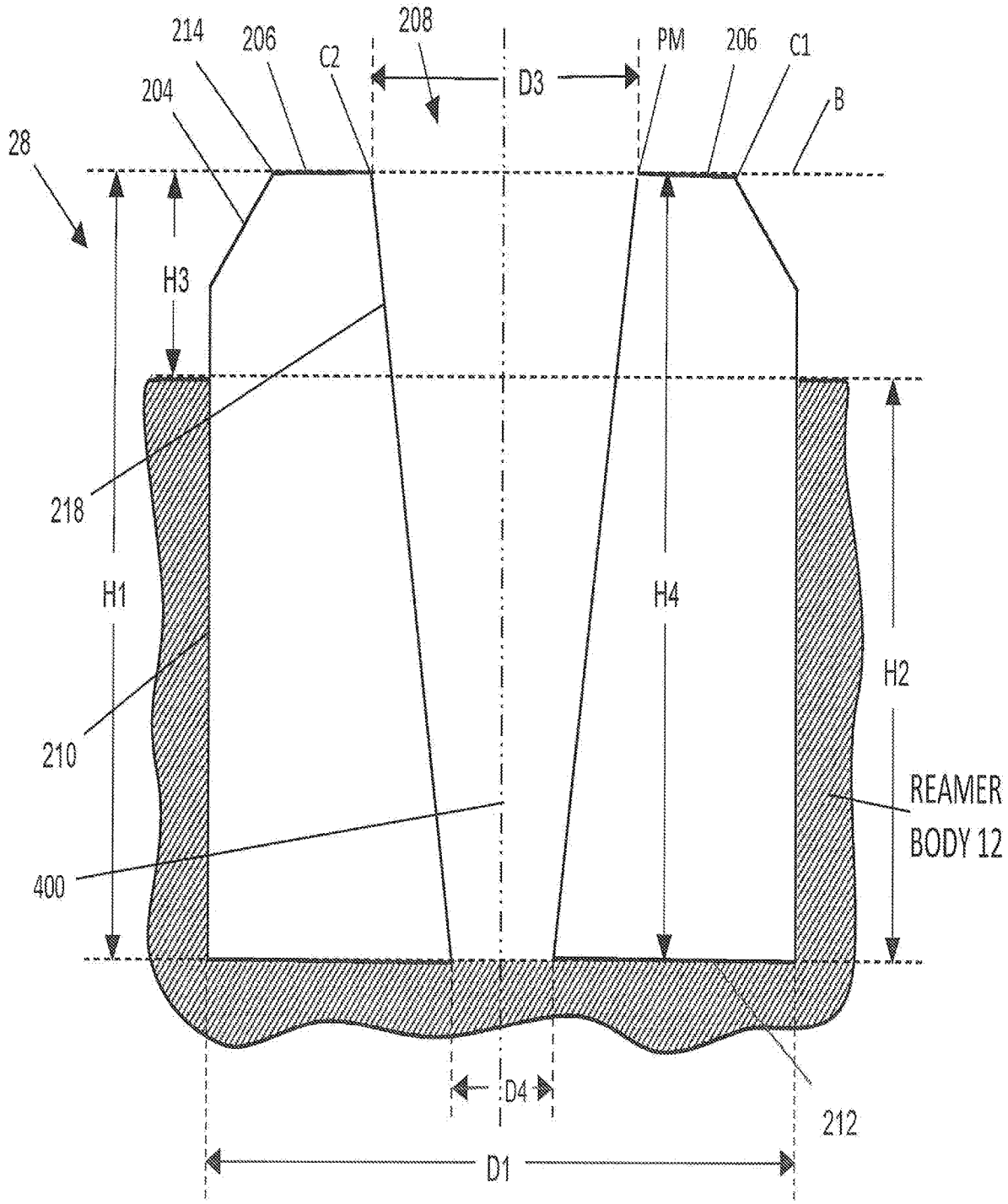
FIG. 4D is a side view of the alternate invented cutting insert of the present invention of FIG. 4A wherein the depression extends entirely through the height of the cutting insert.

Regarding FIG. 4C, FIG. 4C is a view of the bottom surface 212 of the invented cutting insert 28, wherein the cutting insert central axis 400, the first diameter D1 of the invented cutting insert 28, the indents 402, and the fifth diameter D5 of the indents 402, and the side wall 210 of the invented cutting insert 28 are also shown. In optional preferred embodiments of the invented cutting insert 28, the depression 208 may optionally extend through the entirety of the first height H1 of the invented cutting insert 28, such that the depression 208 may be seen through bottom surface 212 of the invented cutting insert 28, as shown in greater detail in FIG. 4D.

Regarding FIG. 4D, FIG. 4D is a side view of the invented cutting insert 28 wherein the depression 208 extends through the entirety of the invented cutting insert 28 along the cutting insert central axis 400, from the top surface 206 to the bottom surface 212. In such an instance, a tapered hollow compartment is formed through the center of the invented cutting insert 28 along the cutting insert central axis 400. The hollow compartment which extends through the invented cutting insert 28 is tapered from the top surface 206 to the bottom surface 212, but may optionally be cylindrical, in such a case the third diameter D3 would be equal to the fourth diameter D4. In the presented embodiment of the invented cutting insert 28 the fourth height H4 of the depression 208 is equal to the first height H1 of the invented cutting insert 28.

Figure 4E:
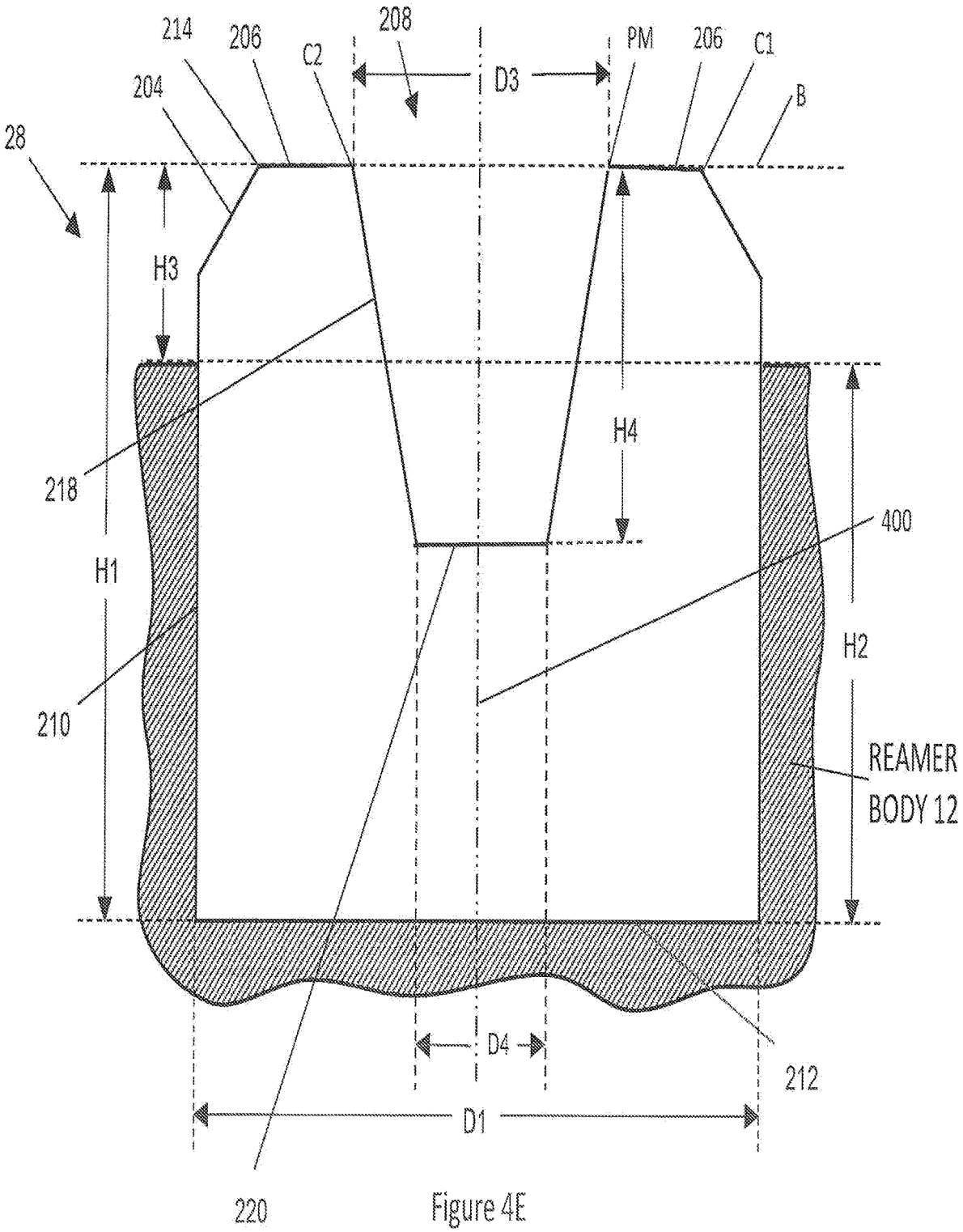
FIG. 4E is a side view of the alternate cutting insert of the present invention of FIG. 4A, wherein the central insert depression extends through half of the height of the cutting insert.
Figure 4F:
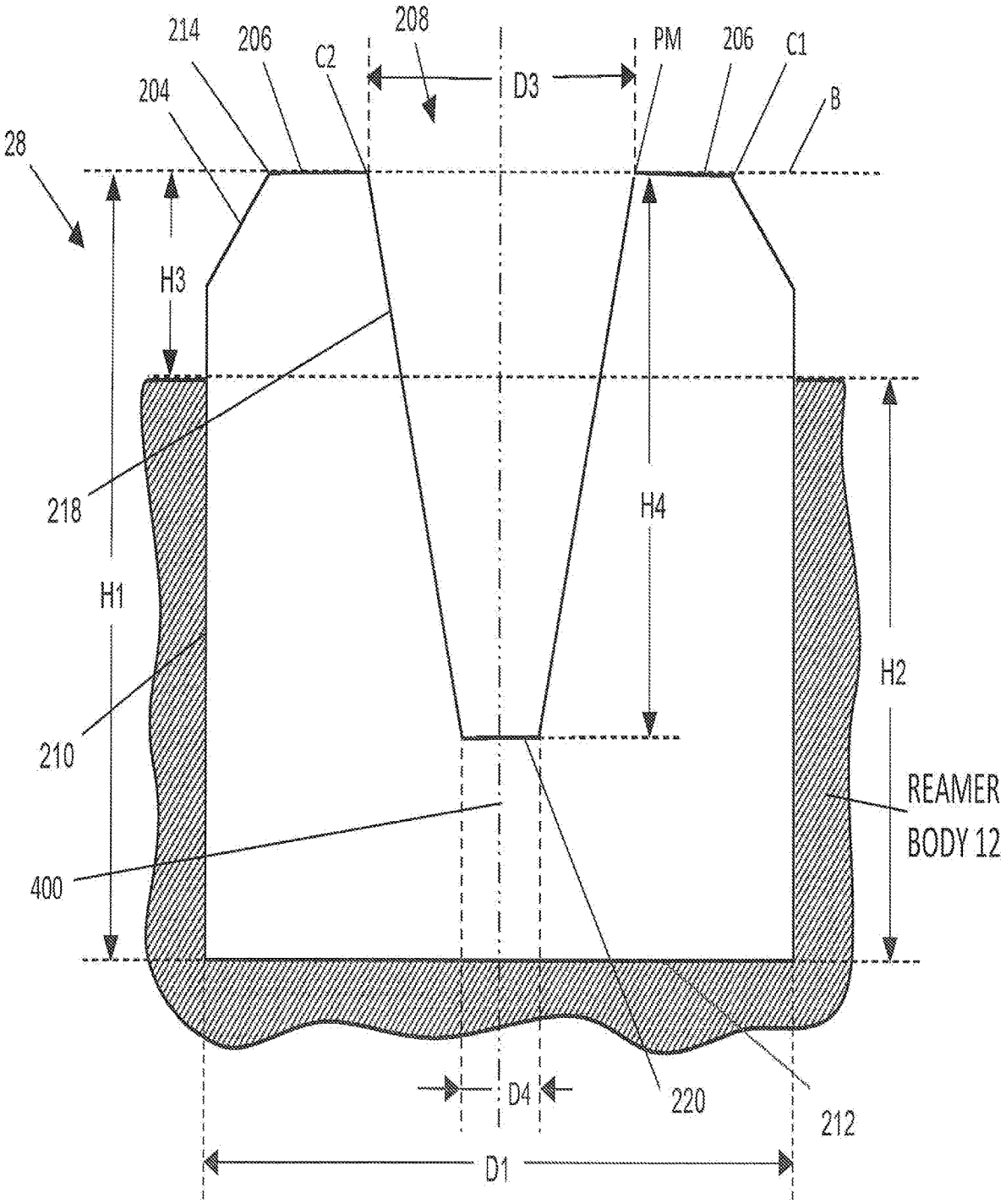
FIG. 4F is a side view of the alternate cutting insert of the present invention of FIG. 4A wherein the central insert depression extends more than half way through the height of the cutting insert.

Regarding FIG. 4E, FIG. 4E is a side view of the invented cutting insert 28 wherein the fourth height H4 of the depression 208 is ½ of the first height H1 of the invented cutting insert 28 along the cutting insert central axis 400. In the presented embodiment of the invented cutting insert 28 the depression 208 extends below the surface of the body 12 of the reamer 10. FIG. 4F is a side view of the invented cutting insert 28 of the method of the present invention wherein the fourth height H4 of the depression 208 extends more than ½ way through the first height H1 of the invented cutting insert 28 along the cutting insert central axis 400, and extends below the surface of the body 12 of the reamer 10.

Figure 4G:
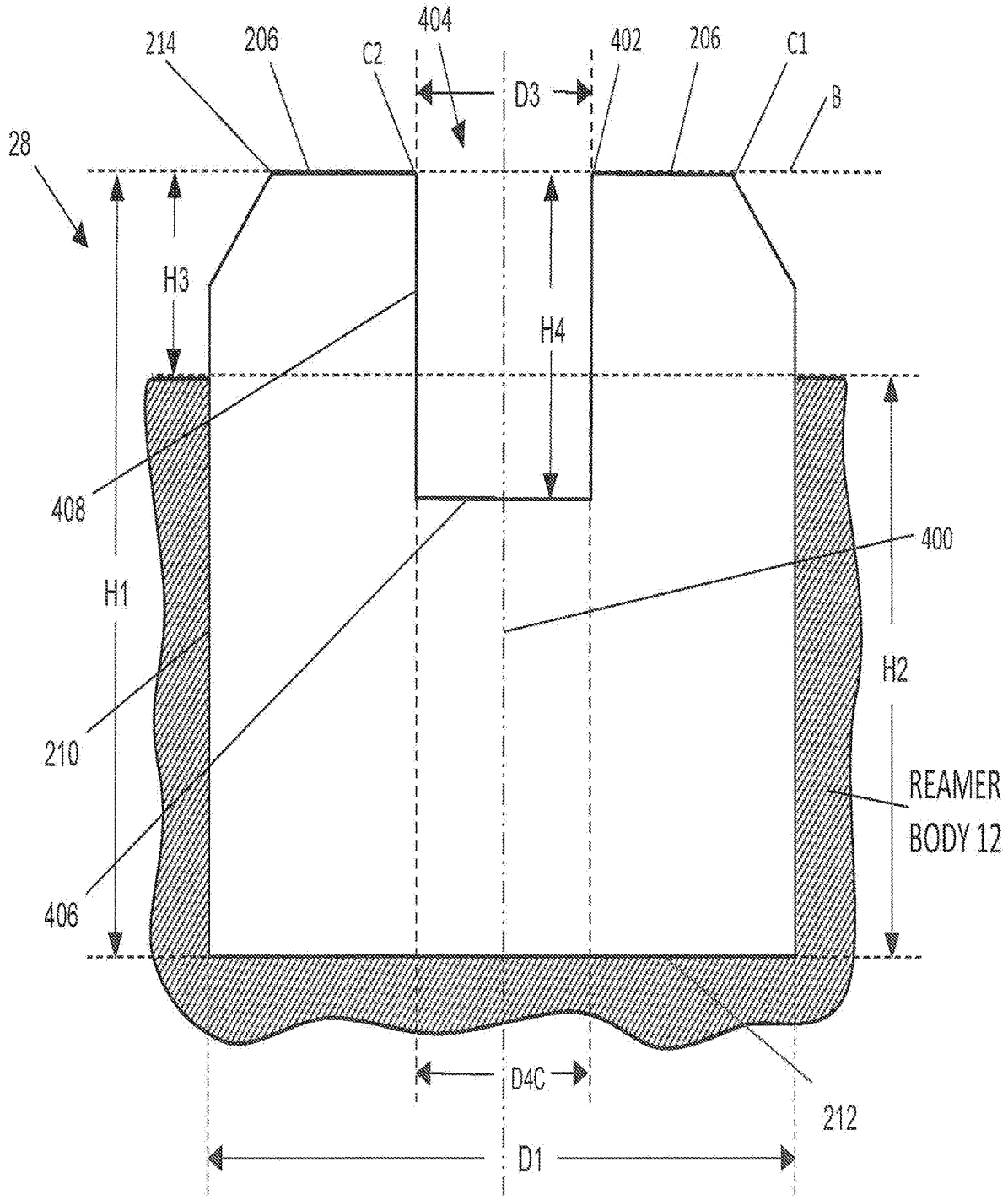
FIG. 4G is a side view of the alternate cutting insert of the present invention of FIG. 4A wherein the central insert depression have a cylindrical form.

Regarding FIG. 4G, FIG. 4G is a side view of the invented cutting insert 28 wherein a cylindrical depression 404 extends along the cutting insert central axis 400 from the height location of the cylindrical inner top edge 402 and the cylindrical depression bottom surface 406. FIG. 4G further illustrates the cylindrical depression wall 408 extending from the cylindrical inner top edge 402 to the cylindrical depression bottom surface 406 where the cylindrical inner top diameter D3 of the depression 410 is equal to a co-planar diameter of the cylindrical bottom depression diameter D4C of the invented cutting insert 28.

Figure 4H:
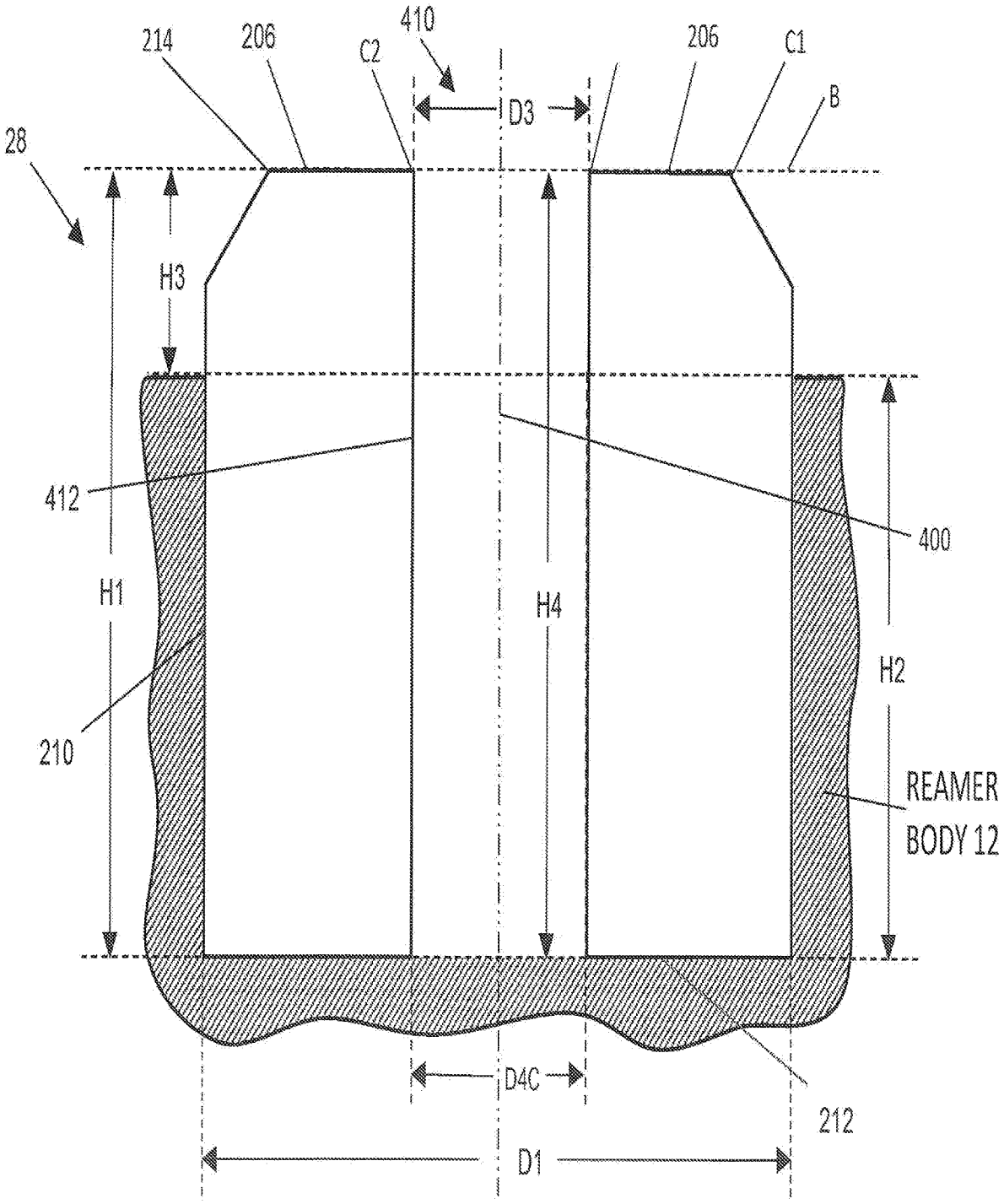
FIG. 4H is a side view of the alternate cutting insert of the present invention of FIG. 4A wherein the central insert depression extends through the entirety of the invented cutting insert.

Regarding FIG. 4H, FIG. 4H is a side view of the invented cutting insert 28 wherein the cylindrical depression 410 extends through the entirety of the invented cutting insert 28 along the cutting insert central axis 400, from the top surface 206 to the bottom surface 212. In the presented embodiment of the invented cutting insert 28 the fourth height H4 of the depression 410 is equal to the first height H1 of the invented cutting insert 28.

Figure 5A:
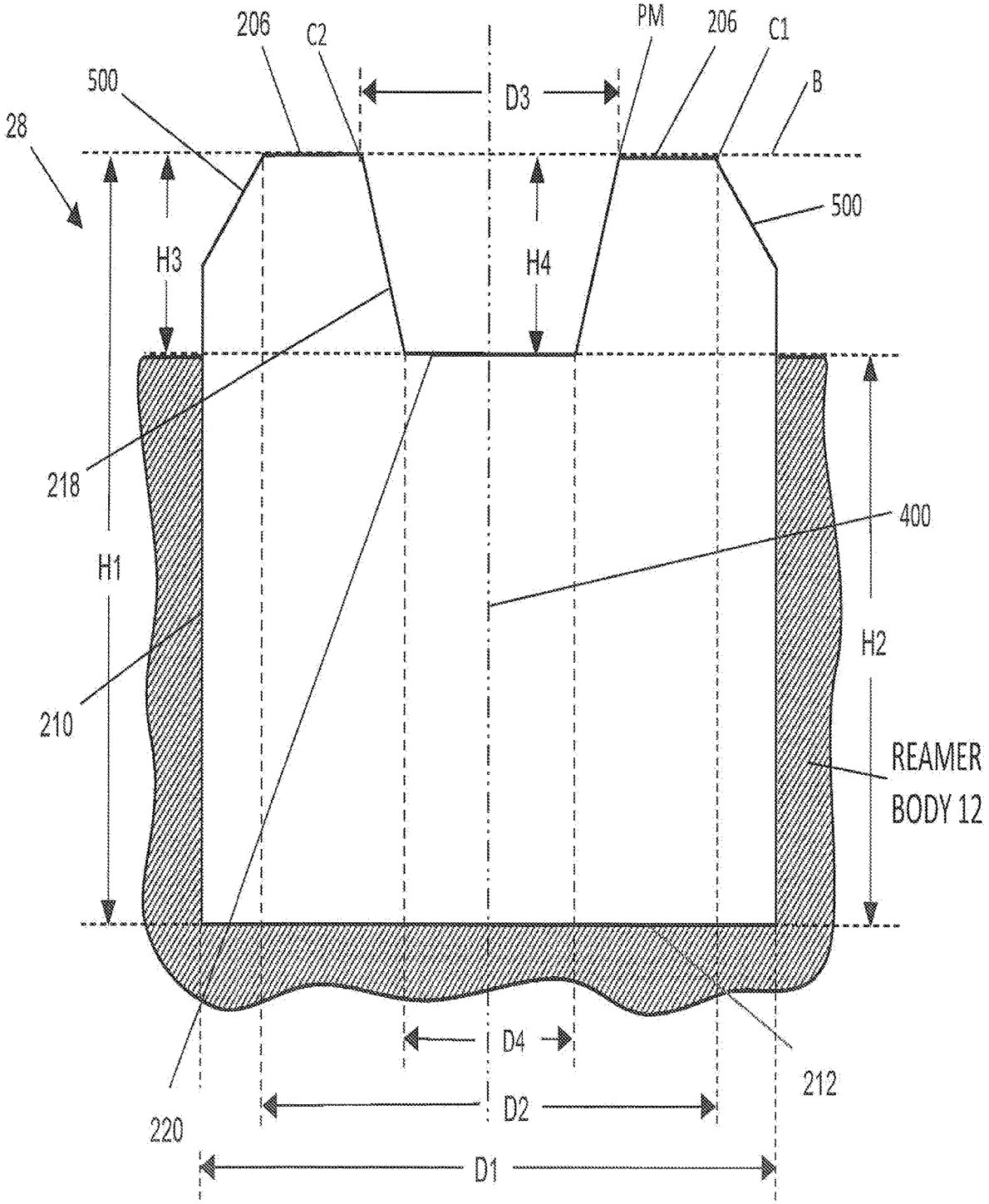
FIG. 5A is a side elevation view of a still alternate embodiment of the invented cutting insert of FIG. 1 having the first cutting edge at a top of a bevel in the sidewall of the cutting insert.

FIG. 5A is a side view of the invented cutting insert 28 having the outer cutting edge C1 at a top of a bevel 500 on the sidewall 210 of the invented cutting insert 28. The outer cutting edge C1 may optionally sit at the top of the sidewall 210, or may optionally be at a beveled edge, depending upon the preference of the manufacturer or the user of the cutting insert. The depth of the angle of the bevel 500, i.e. the total distance between the first diameter D1 of the invented cutting insert 28 and the second diameter D2 of the top surface 206 of the invented cutting insert 28, may additionally be determined by manufacturing specifications. In the shown embodiment of the invented cutting insert 28, the second diameter D2 is preferably smaller than the first diameter D1.

Figure 5B:
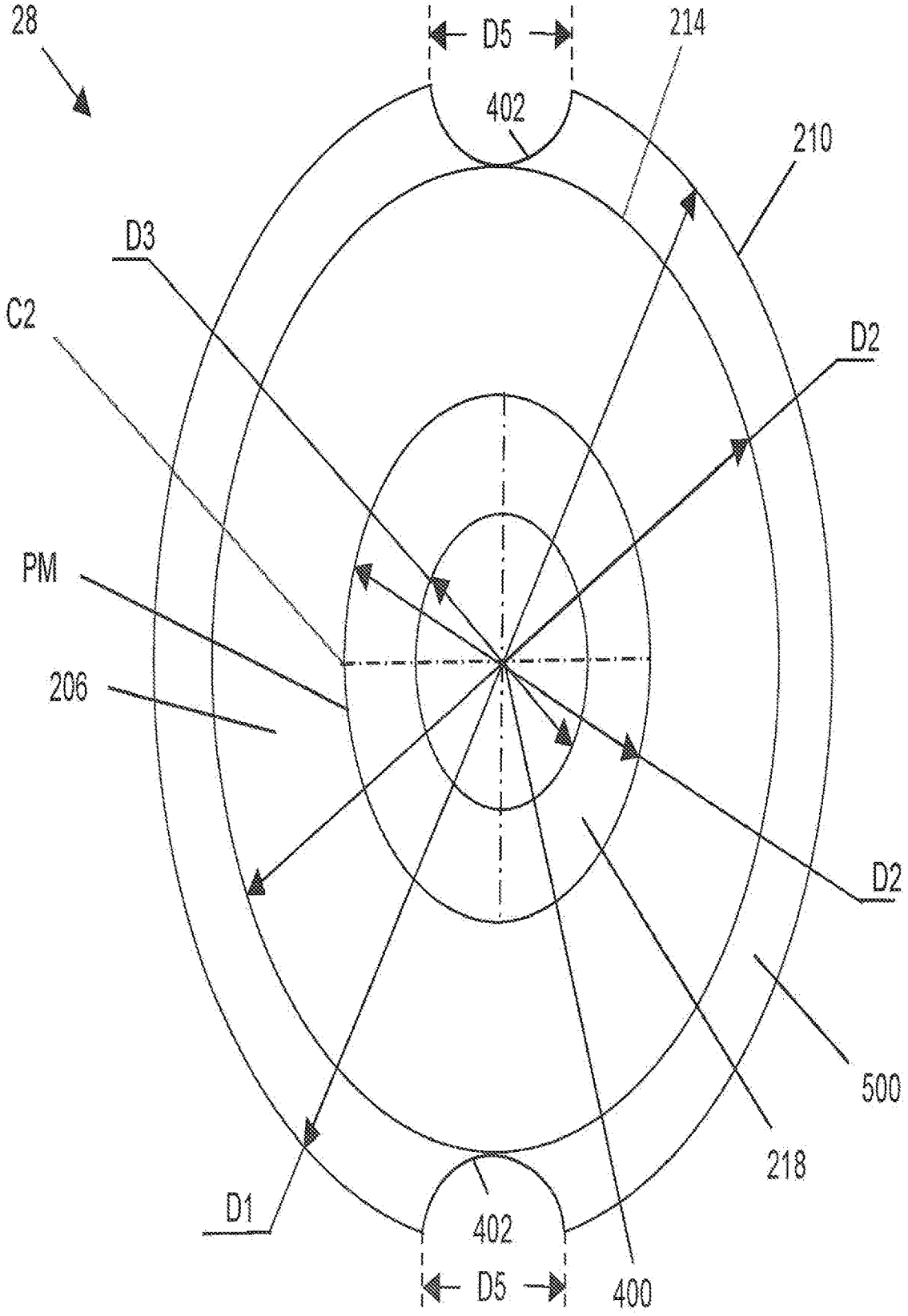
FIG. 5B is a top plan view of the still alternate embodiment of the invented cutting insert of FIG. 5A.

FIG. 5B is a top view of the invented cutting insert 28 having the outer cutting edge C1 at the top of a bevel on the sidewall 210 of the invented cutting insert 28, such that the fifth diameter D5 of the top surface 206 is less than the first diameter D1 of the invented cutting insert 28.

Figure 6A:
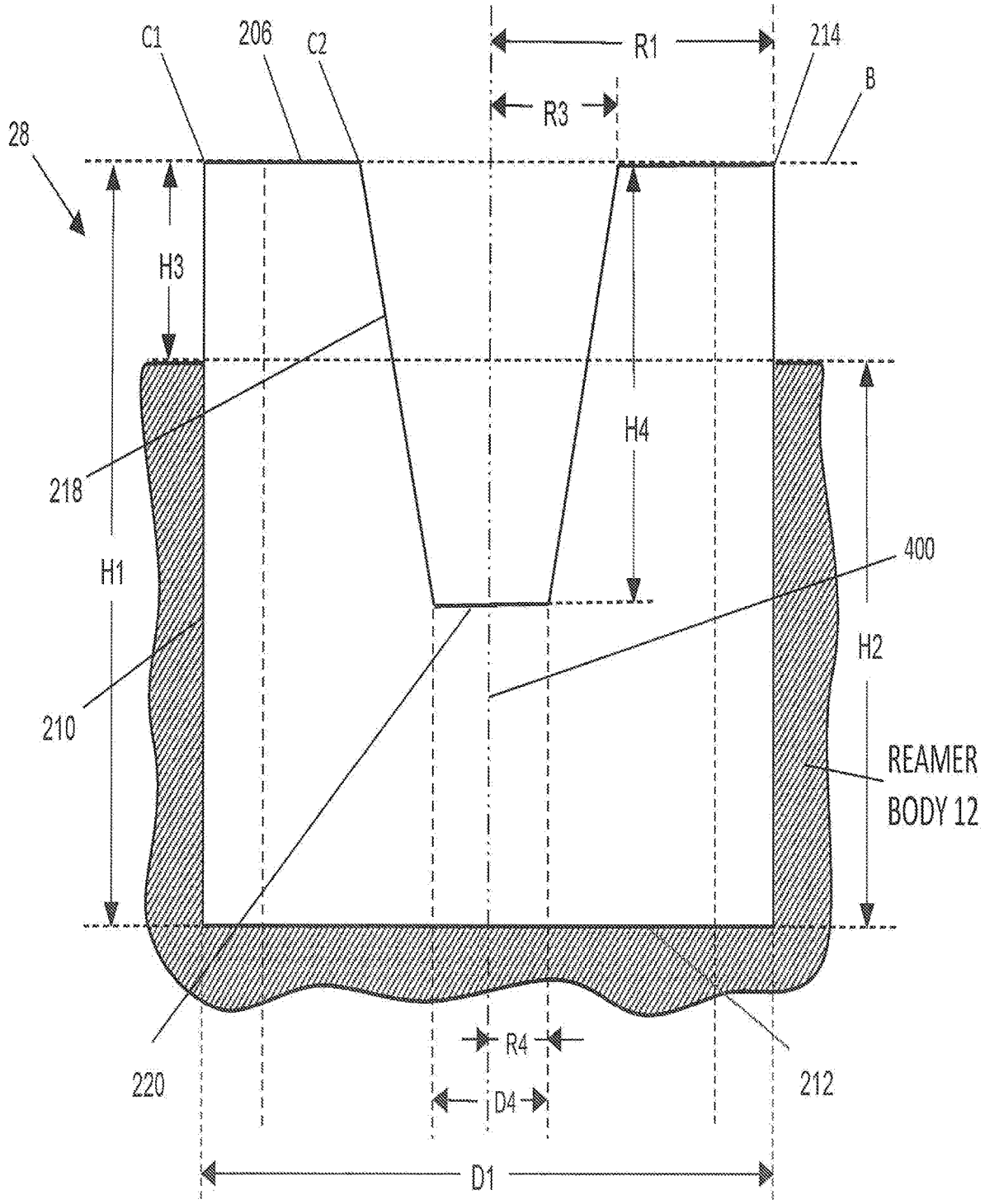
FIG. 6A is a side elevation view of the cutting insert of the method of the present invention of FIG. 2B.

Regarding FIG. 6A, FIG. 6A is a side view of the invented cutting insert 28 showing a plurality of radii R1-R4. A first radius R1 extends from the cutting insert central axis 400 to the sidewall 210 of the invented cutting insert 28, and is preferably half of the length of the first diameter D1. A second radius R2 is shown to extend from the cutting insert central axis 400 to an inner edge of the indents 402, wherein the second radius R2 defines the outer top edge 214. A third radius R3 of the top of the depression 208 extends from the cutting insert central axis 400 to the inner cutting edge C2 of a top of the depression 208, wherein the top of the depression 208 is flush with the top surface 206 of the invented cutting insert 28 and with the boring plane P; the length of the third radius R3 is preferably half of the length of the third diameter D3. A fourth radius R4 extends from the cutting insert central axis 400 to an edge of a bottom of the depression 208 of the invented cutting insert 28. The fourth radius R4 is shown in the FIG. 6A to describe a bottom of the depression 208 which is flush with the body 12 of the reamer 10, but the depression 208 may optionally extend as far into the body 12 of the reamer 10 as is deemed necessary by a user and/or a manufacturer of the reamer 10, and the fourth radius R4 preferably always describes the bottom of the depression 208.

Figure 6B:
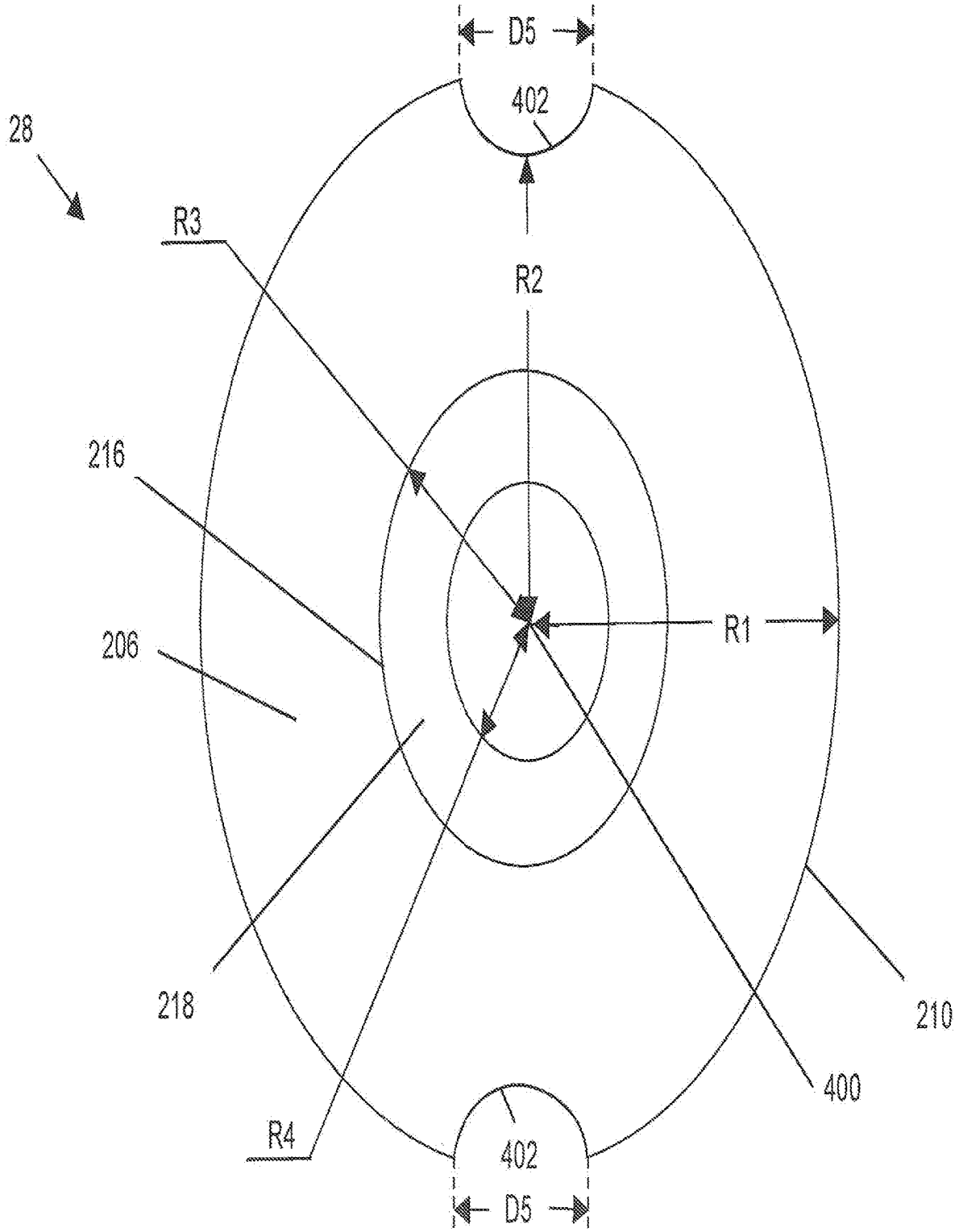
FIG. 6B is a top plan view of the cutting insert of the method of the present invention of FIG. 2B.

Regarding FIG. 6B, FIG. 6B is view of the top surface 206 of the invented cutting insert 28 showing the first radius R1 of the invented cutting insert 28, second radius R2 defining of the displacement between the cutting insert central axis 400 and an inner edge of the indent 402, the third radius R3 of the top of the depression 208, and the fourth radius R4 of the bottom of the depression 208, Additionally shown in FIG. 5B is the diameter D1 of the invented cutting insert 28, the sidewall 210, the cutting insert central axis 400, and the indents 402.

Figure 7A:
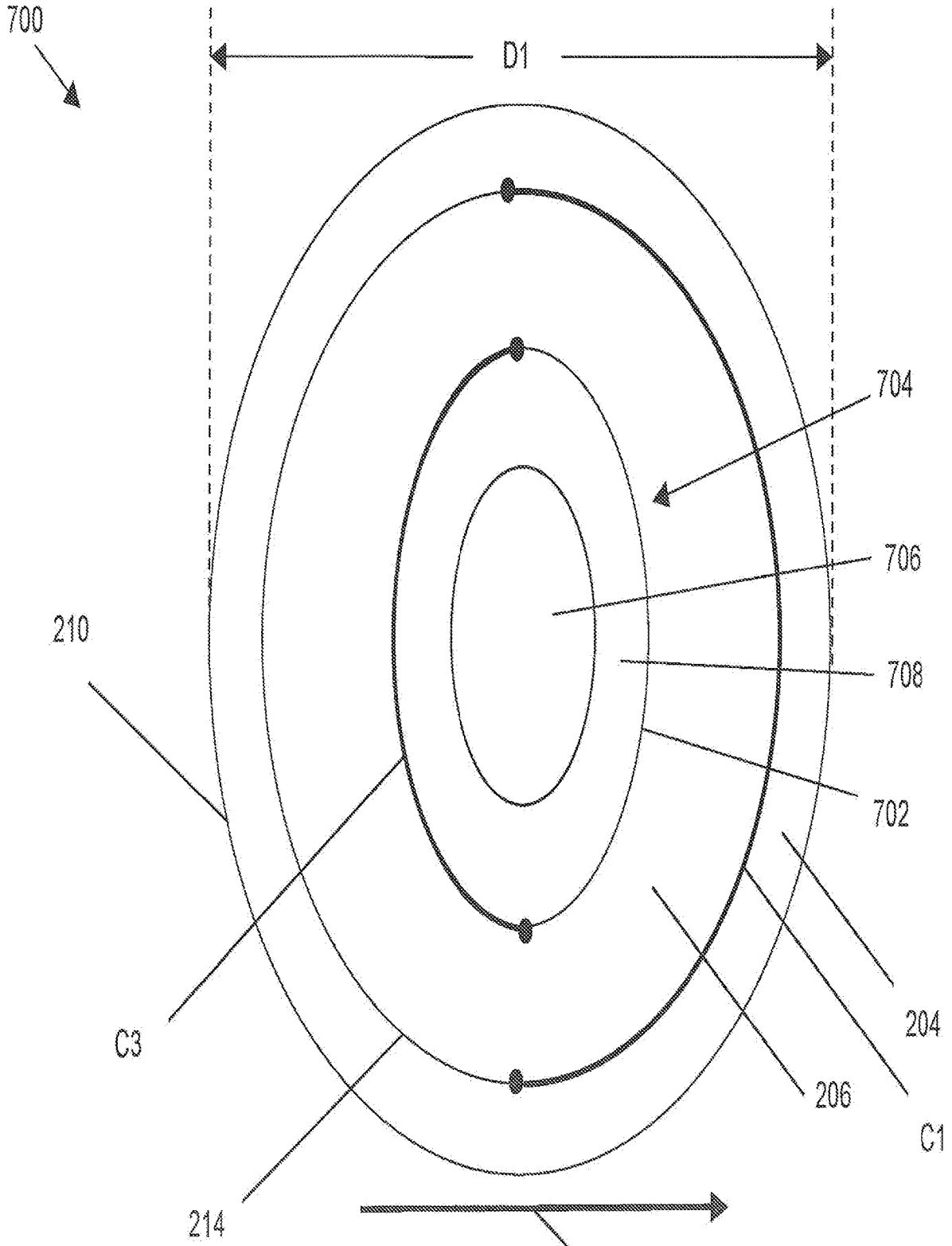
FIG. 7A is a top plan view of a second alternate preferred ovoid embodiment of the first invented cutting insert of FIG. 2B.

Referring now generally to the Figures and particularly FIG. 7A, FIG. 7A is a top plan view of a second alternate preferred embodiment of the invented cutting insert 700 (hereinafter, "ovoid cutting insert" 700). The ovoid cutting insert 700 presents the first diameter D1 of the bottom surface 212, the outer top edge 214, and an ovoid inner top edge 702. An ovoid depression 704 of the ovoid cutting insert 700 includes an ovoid depression surface 706 and an ovoid depression wall 708. The ovoid depression wall 708 extends from the ovoid inner top edge 702 to the ovoid depression surface 706. The top surface 206 extends from, and is positioned between, the ovoid inner top edge 702 and the outer top edge 214.

When the reamer 10 is in rotational motion and traversing in the indicated angular direction 300, the outer cutting edge C1 of the outer top edge 214 and an ovoid inner cutting edge C3 of the ovoid inner top edge 702 make contact with the sides of the borehole. In other words, the outer cutting edge C1 of the outer top edge 214 is defined as that portion of the outer top edge 214 that makes contact with the borehole and cuts away rock and components of the borehole as the reamer 10 is rotated within the borehole and about the central elongate axis 29; the ovoid inner cutting edge C3 of the ovoid inner top edge 702 is defined as that portion of the ovoid inner top edge 702 that makes contact with the borehole and cuts away rock and components of the borehole as the reamer 10 is rotated within the borehole and about the central elongate axis 29. When wear occurs on the ovoid inner cutting edge C3, the resultant wear of the ovoid cutting insert 700 mostly or preferably exclusively cuts into the top surface 206, rather than increasing the size of the ovoid depression 704.

Figure 7B:
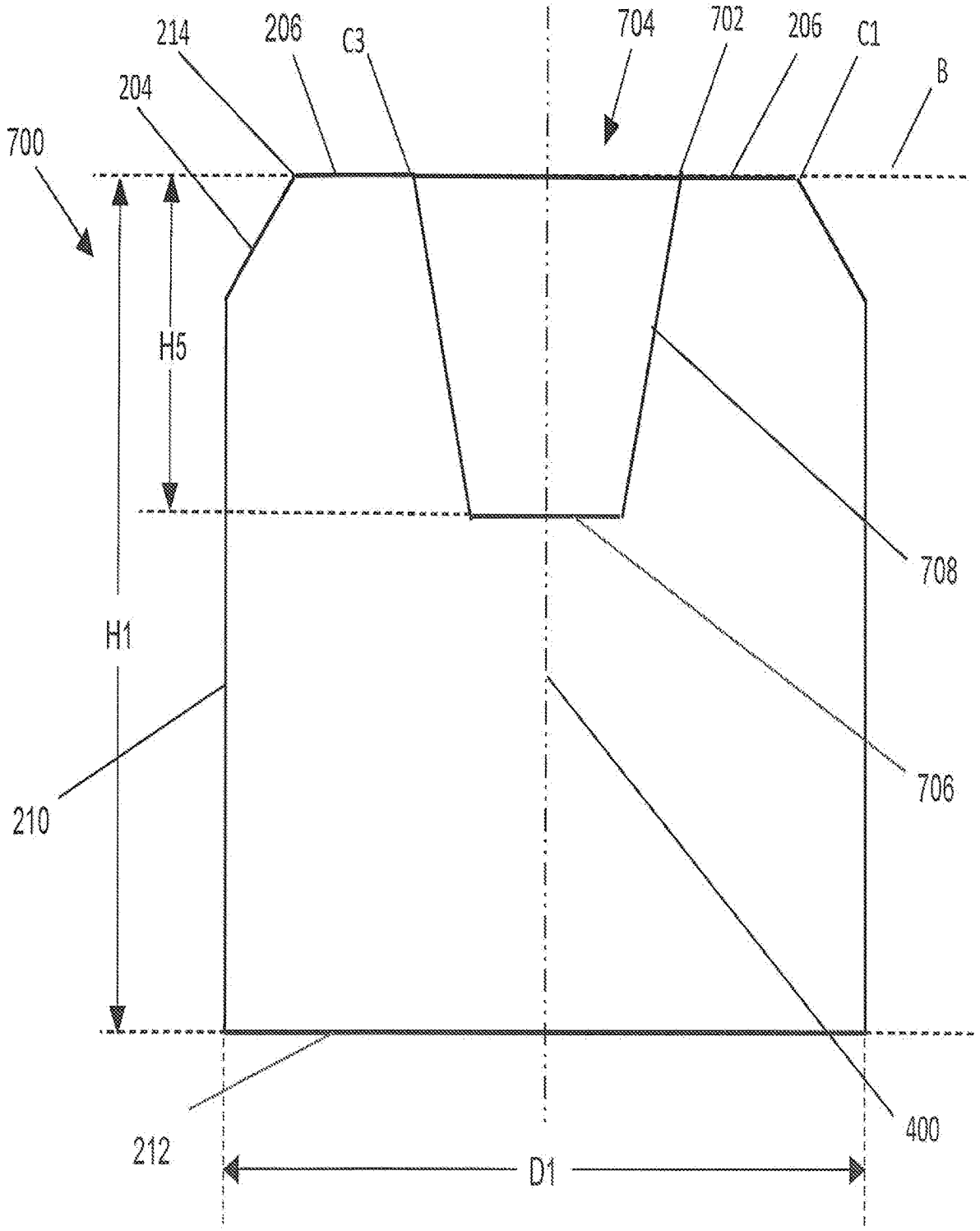
FIG. 7B is a side elevation view of the second alternate preferred ovoid embodiment of the invented cutting insert of FIG. 7A.

Regarding FIG. 7B, FIG. 7B is a side elevation view of the ovoid cutting insert 700, showing a plurality of dimensions according to which the ovoid cutting insert 700 may preferably be built.

The first height H1 of the sidewall 210 of the ovoid cutting insert 700 concentric to a cutting insert central axis 400 extending between the top surface 206 of the ovoid cutting insert 700 and the bottom surface 212 of the ovoid cutting insert 700, wherein the first height H1 is preferably within the range of from 0.01 inches to 5.0 inches or greater and more preferably within the range of 1⅜ inches to 2¼ inches. A fifth height H5 represents a depth of the ovoid depression 704 extending along the cutting insert central axis 400 from the height location of the ovoid inner top edge 702 and the ovoid depression bottom surface 706. FIG. 7B further illustrates the ovoid depression wall 708 extending from the ovoid inner top edge 702 to the ovoid depression bottom surface 706.

It is understood that the outer top edge 214 ovoid inner top edge 702 and/or the ovoid depression 704 may be approximately or substantively axi-symmetric in orientation to the cutting insert central axis 400.

Figure 8A:
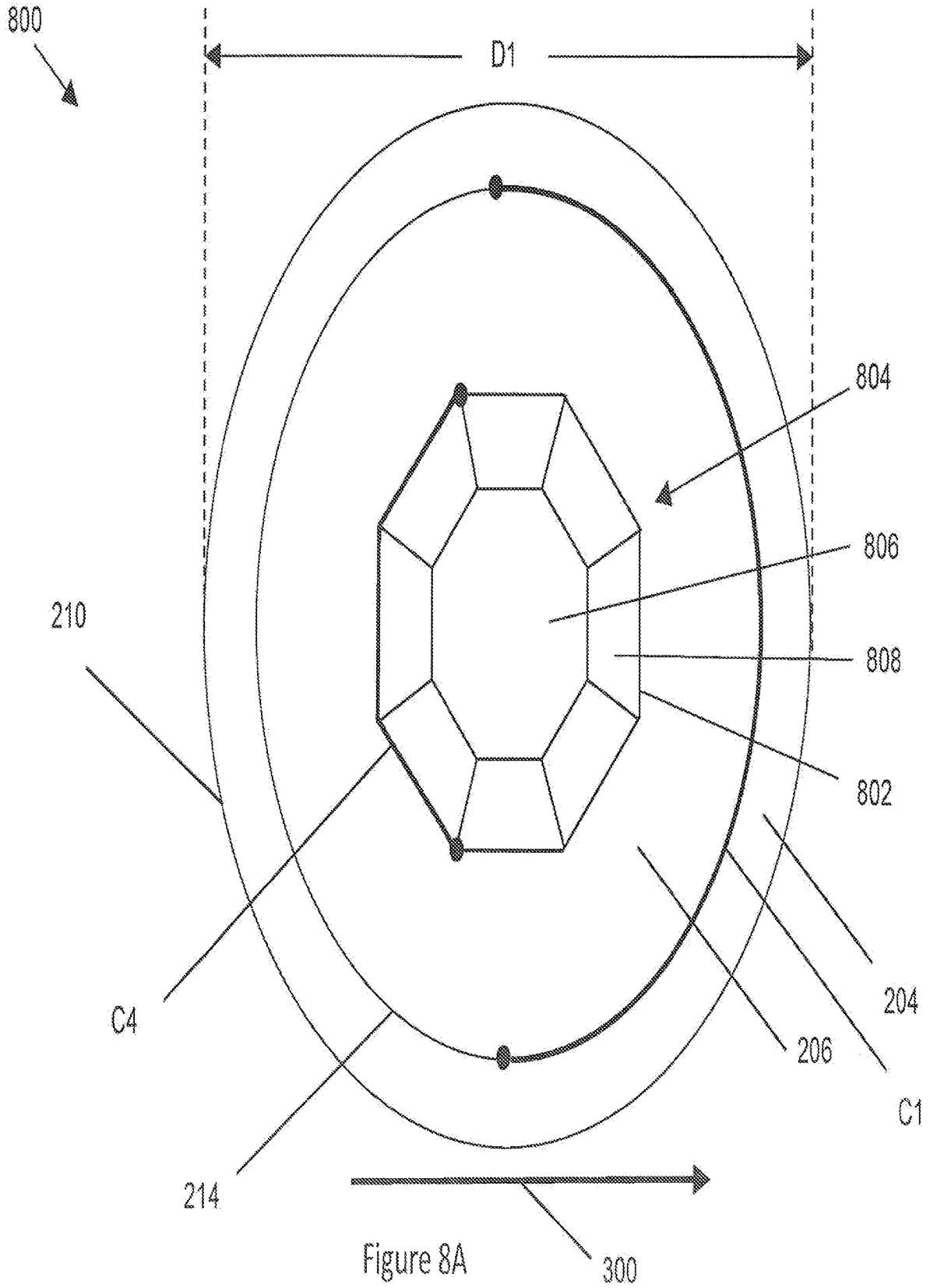
FIG. 8A is a top plan view of a third alternate preferred octagonal embodiment of the invented cutting insert of FIG. 2B.

Referring now generally to the Figures and particularly FIG. 8A, FIG. 8A is a top plan view of a third alternate preferred embodiment of the invented cutting insert 800 (hereinafter, "octagonal cutting insert" 800). The octagonal cutting insert 800 presents the first diameter D1 of the bottom surface 212, the outer top edge 214, and an octagonal inner top edge 802. An octagonal depression 804 of the octagonal cutting insert 800 includes an octagonal depression surface 806 and an octagonal depression wall 808. The octagonal depression wall 808 extends from the octagonal inner top edge 802 to the octagonal depression surface 806. The top surface 206 extends from, and is positioned between, the octagonal inner top edge 802 and the outer top edge 214.

When the reamer 10 is in rotational motion and traversing in the indicated angular direction 300, the outer cutting edge C1 of the outer top edge 214 and an octagonal inner cutting edge C4 of the octagonal inner top edge 802 make contact with the sides of the borehole. In other words, the outer cutting edge C1 of the outer top edge 214 is defined as that portion of the outer top edge 214 that makes contact with the borehole and cuts away rock and components of the borehole as the reamer 10 is rotated within the borehole and about the central elongate axis 29; the octagonal inner cutting edge C4 of the octagonal inner top edge 802 is defined as that portion of the octagonal inner top edge 802 that makes contact with the borehole and cuts away rock and components of the borehole as the reamer 10 is rotated within the borehole and about the central elongate axis 29. When wear occurs on the octagonal inner cutting edge C4, the resultant wear of the octagonal cutting insert 800 mostly or preferably exclusively cuts into the top surface 206, rather than increasing the size of the octagonal depression 804.

Figure 8B:
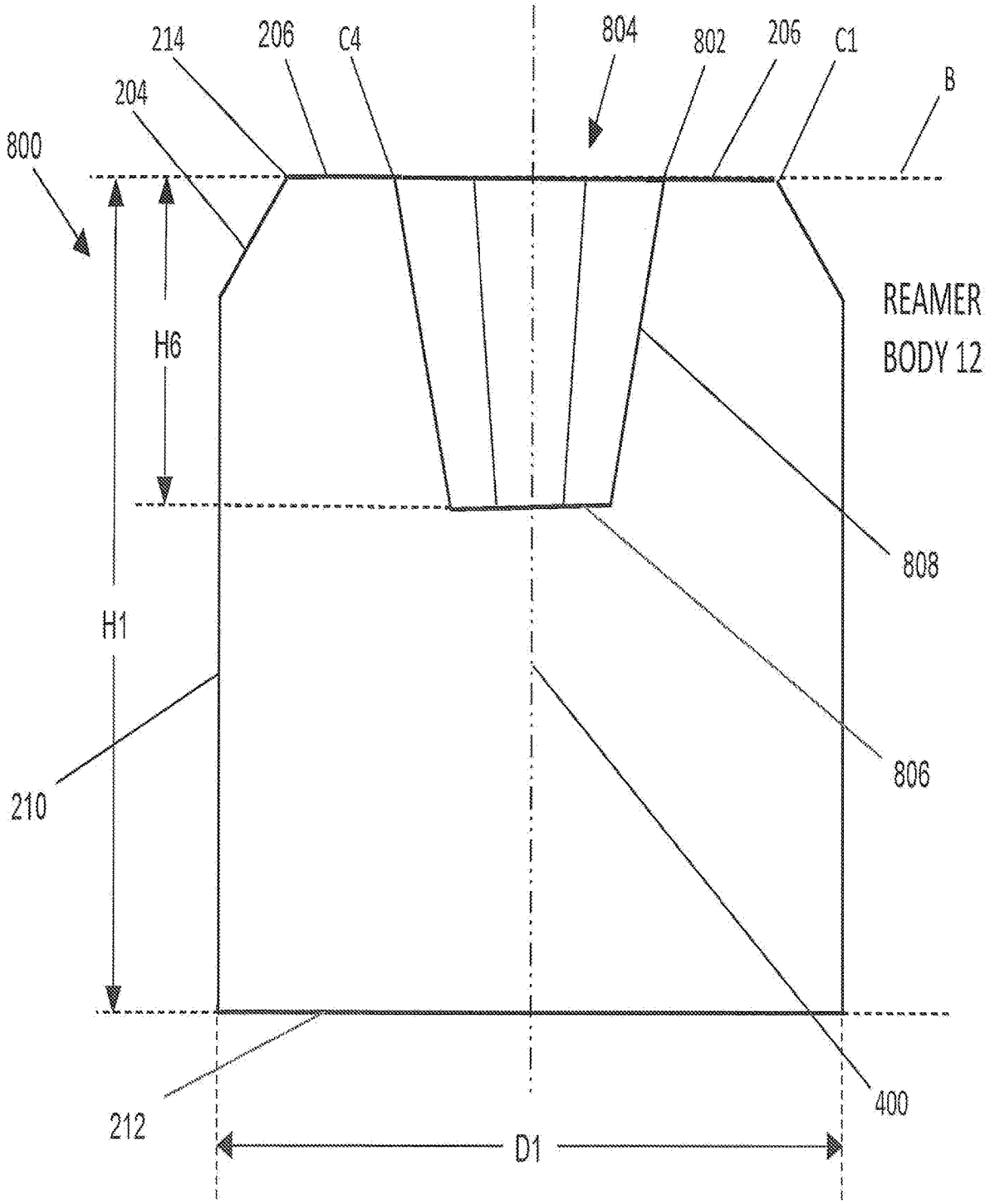
FIG. 8B is a side elevation view of the alternate preferred octagonal embodiment of the invented cutting insert of FIG. 8B.

Regarding FIG. 8B, FIG. 8B is a side elevation view of the octagonal cutting insert 800, showing a plurality of dimensions according to which the octagonal cutting insert 800 may preferably be built.

The first height H1 of the sidewall 210 of the octagonal cutting insert 800 concentric to a cutting insert central axis 400 extending between the top surface 206 of the octagonal cutting insert 800 and the bottom surface 212 of the octagonal cutting insert 800, wherein the first height H1 is preferably within the range of from 0.01 inch to 5.0 inches or greater and more preferably within the range of 1⅜ inches to 2¼ inches. A sixth height H6 represents a depth of the octagonal depression 804 extending along the cutting insert central axis 400 from the location of the octagonal inner top edge 802 and the octagonal depression bottom surface 806. FIG. 8B further illustrates the octagonal depression wall 808 extending from the octagonal inner top edge 802 to the octagonal depression bottom surface 806.

It is understood that the outer top edge 214, the octagonal inner top edge 802 and/or the octagonal depression 804 may be approximately or substantively axi-symmetric in orientation to the cutting insert central 400.

Figure 9A:
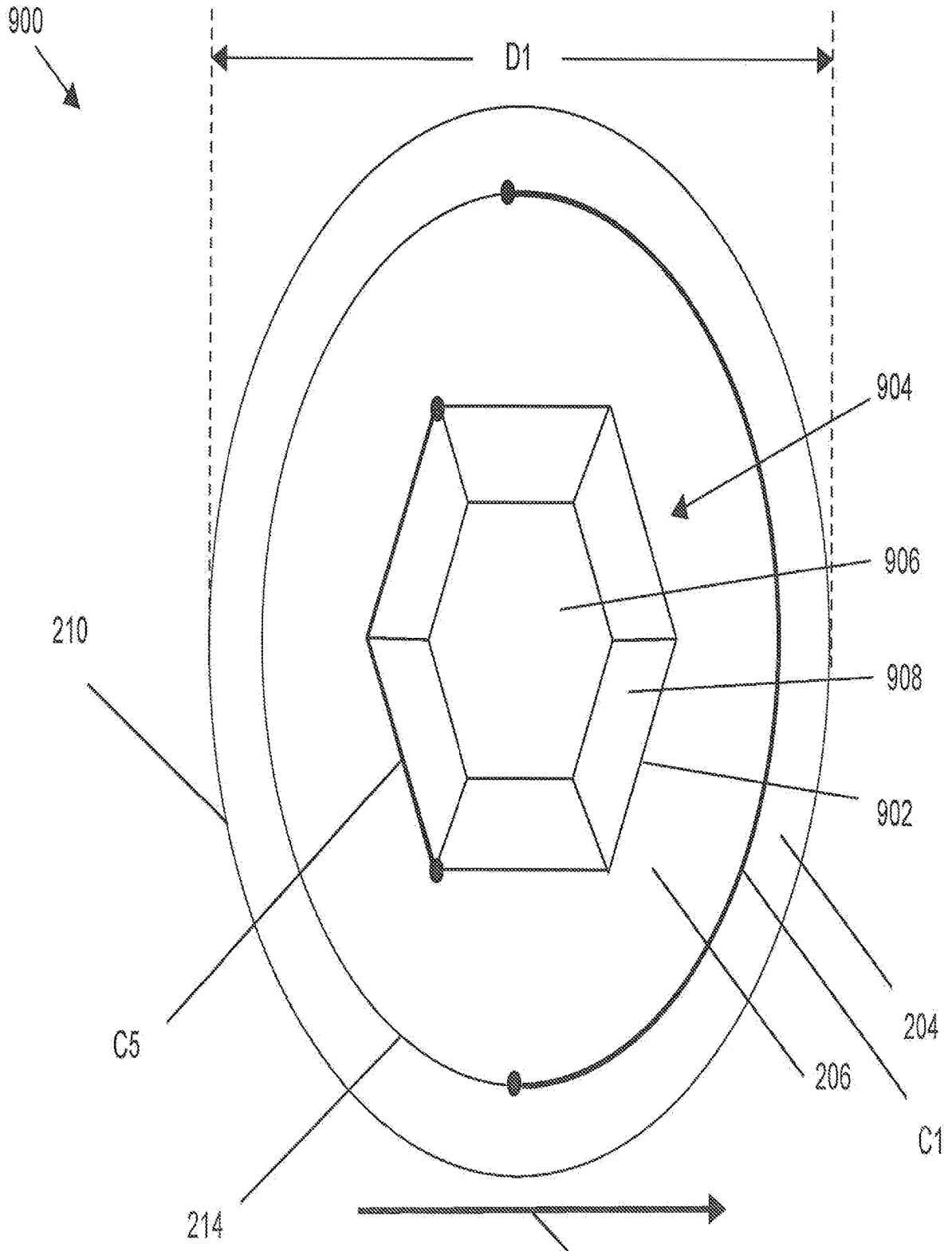
FIG. 9A is a top plan view of a fourth alternate preferred hexagonal embodiment of the invented cutting insert of FIG. 2B.

Referring now generally to the Figures and particularly FIG. 9A, FIG. 9A is a top plan view of a fourth alternate preferred embodiment of the invented cutting insert 900 (hereinafter, "hexagonal cutting insert" 900). The hexagonal cutting insert 900 presents the first diameter D1 of the bottom surface 212, the outer top edge 214, and an hexagonal inner top edge 902. An hexagonal depression 904 of the hexagonal cutting insert 900 includes an hexagonal depression surface 906 and an hexagonal depression wall 908. The hexagonal depression wall 908 extends from the hexagonal inner top edge 902 to the hexagonal depression surface 906. The top surface 206 extends from, and is positioned between, the hexagonal inner top edge 902 and the outer top edge 214.

When the reamer 10 is in rotational motion and traversing in the indicated angular direction 300, the outer cutting edge C1 of the outer top edge 214 and an hexagonal inner cutting edge C5 of the hexagonal inner top edge 902 make contact with the sides of the borehole. In other words, the outer cutting edge C1 of the outer top edge 214 is defined as that portion of the outer top edge 214 that makes contact with the borehole and cuts away rock and components of the borehole as the reamer 10 is rotated within the borehole and about the central elongate axis 29; the hexagonal inner cutting edge C5 of the hexagonal inner top edge 902 is defined as that portion of the hexagonal inner top edge 902 that makes contact with the borehole and cuts away rock and components of the borehole as the reamer 10 is rotated within the borehole and about the central elongate axis 29. When wear occurs on the hexagonal inner cutting edge C5, the resultant wear of the hexagonal cutting insert 900 mostly or preferably exclusively cuts into the top surface 206, rather than increasing the size of the hexagonal depression 904. It is understood that the hexagonal inner top edge 902 and/or the hexagonal depression 904 may be approximately or substantively axi-symmetric in orientation to the cutting insert central 400.

Figure 9B:
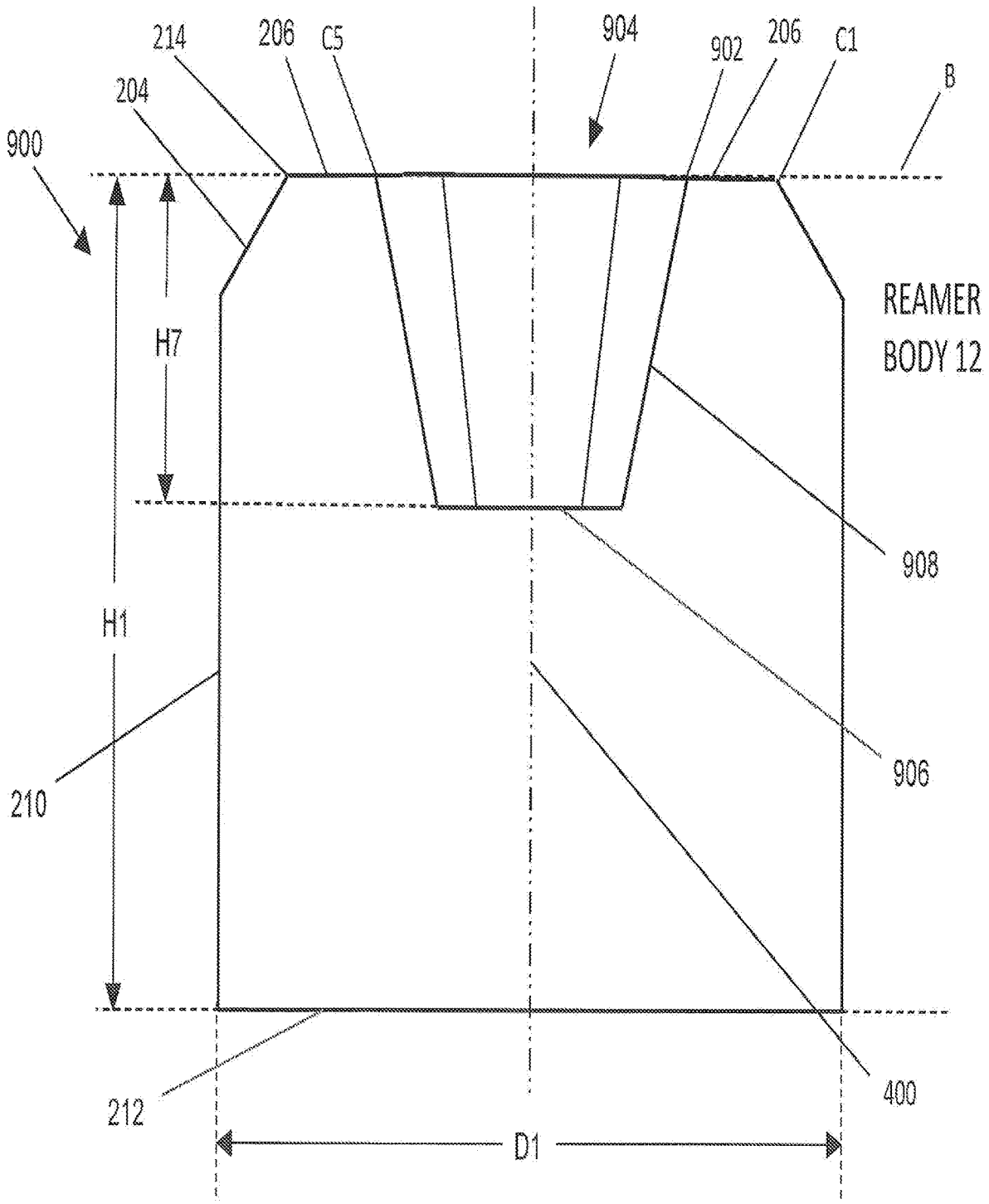
FIG. 9B is a side elevation view of the fourth alternate preferred hexagonal embodiment of the invented cutting insert of FIG. 2B.

Regarding FIG. 9B, FIG. 9B is a side elevation view of the hexagonal cutting insert 900, showing a plurality of dimensions according to which the hexagonal cutting insert 900 may preferably be built.

The first height H1 of the sidewall 210 of the hexagonal cutting insert 900 concentric to a cutting insert central axis 400 extending between the top surface 206 of the hexagonal cutting insert 900 and the bottom surface 212 of the hexagonal cutting insert 900, wherein the first height H1 is preferably within the range of from 0.01 inch to 5.0 inches or greater and more preferably within the range of 1⅜ inches to 2¼ inches. A seventh height H7 represents a depth of the hexagonal depression 904 extending along the cutting insert central axis 400 from the location of the hexagonal inner top edge 902 and the hexagonal depression bottom surface 906. FIG. 9B further illustrates the hexagonal depression wall 908 extending from the hexagonal inner top edge 902 to the hexagonal depression bottom surface 906.

Figure 10A:
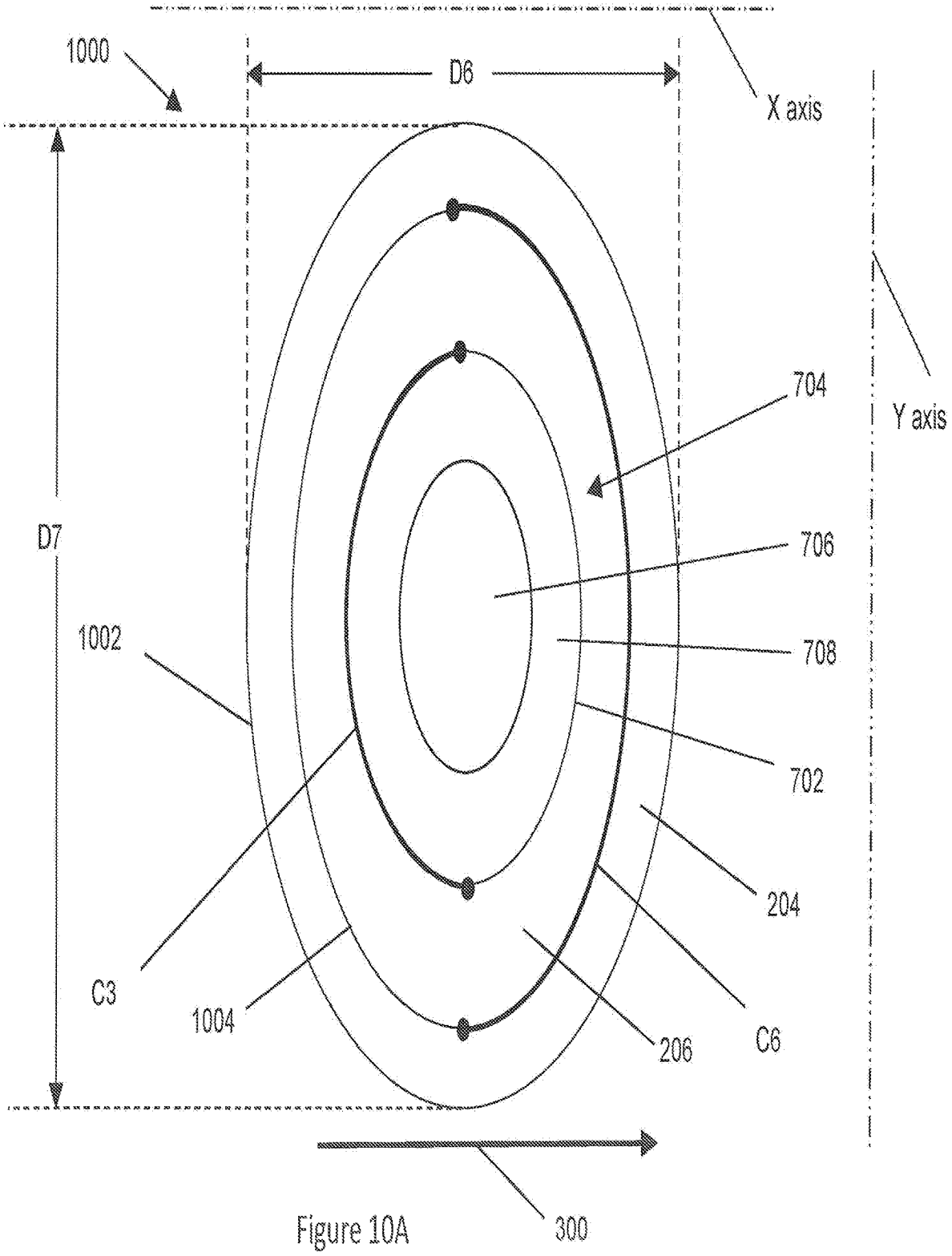
FIG. 10A is a top plan view of a second alternate ovoid embodiment of the invented cutting insert of FIG. 2B.

Referring now generally to the Figures and particularly FIG. 10A, FIG. 10A is a top plan view of a second alternate ovoid embodiment of the invented cutting insert 1000 (hereinafter, "second ovoid cutting insert" 1000). The second ovoid cutting insert 1000 an ovoid sidewall 1002 an ovoid top outer edge 1014, and the ovoid inner top edge 702. The ovoid depression 704 of the second ovoid cutting insert 1000 includes the ovoid depression surface 706 and the ovoid depression wall 708. The ovoid depression wall 708 extends from the ovoid inner top edge 702 to the ovoid depression surface 706. The top surface 206 extends from, and is positioned between, the ovoid inner top edge 702 and the ovoid top outer edge 1004.

When the reamer 10 is in rotational motion and traversing in the indicated angular direction 300, an ovoid outer cutting edge C6 of the ovoid top outer edge 1014 and the ovoid inner cutting edge C3 of the ovoid inner top edge 702 make contact with the sides of the borehole. In other words, the ovoid outer cutting edge C6 of the ovoid top outer edge 1004 is defined as that portion of the ovoid top outer edge 1004 that makes contact with the borehole and cuts away rock and components of the borehole as the reamer 10 is rotated within the borehole and about the central elongate axis 29. When wear occurs on the ovoid inner cutting edge C3, the resultant wear of the second ovoid cutting insert 1000 mostly or preferably exclusively cuts into the top surface 206, rather than increasing the size of the ovoid depression 704.

Figure 10B:
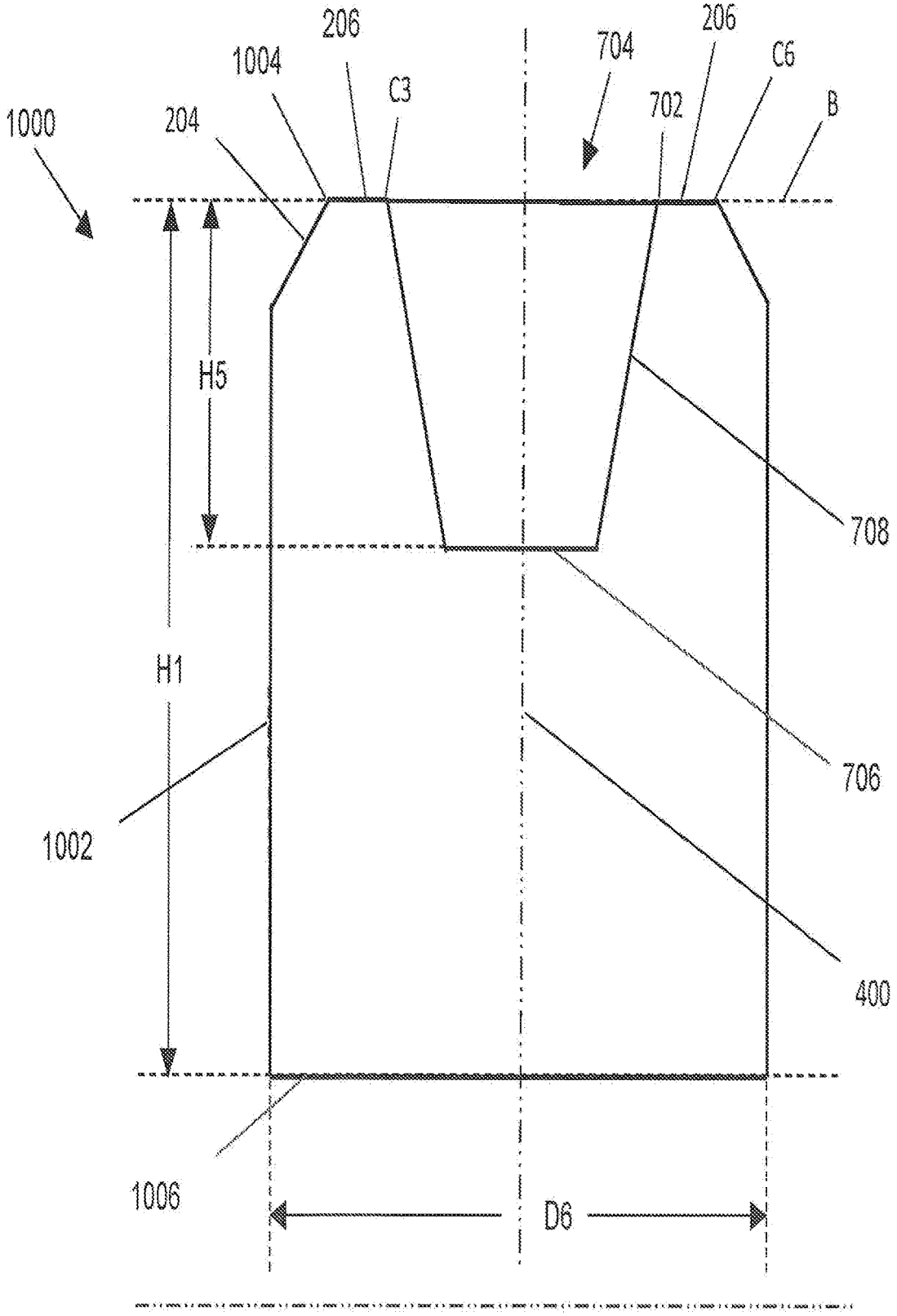
FIG. 10B is a side elevation view of the second alternate preferred ovoid embodiment of the invented cutting insert of FIG. 7A.

Regarding FIG. 10B, FIG. 10B is a side elevation view of the second ovoid cutting insert 100, showing a plurality of dimensions according to which the ovoid cutting insert 1000 may preferably be built.

The first height H1 of the ovoid sidewall 1002 of the second ovoid cutting insert 1000 may be axi-symmetric to a cutting insert central axis 400 extending between the top surface 206 of the second ovoid cutting insert 1000 and a bottom surface 1006 of the second ovoid cutting insert 1000, wherein the first height H1 is preferably within the range of from 0.01 inches to 5.0 inches or greater and more preferably within the range of 1⅜ inches to 2¼ inches. A fifth height H5 represents a depth of the ovoid depression 704 extending along the cutting insert central axis 400 from the height location of the ovoid inner top edge 702 and the ovoid depression bottom surface 706. FIG. 10B further illustrates the ovoid depression wall 708 extending from the ovoid inner top edge 702 to the ovoid depression bottom surface 706.

It is understood that the ovoid top outer edge 1004, ovoid inner top edge 702 and/or the ovoid depression 704 may be approximately or substantively axi-symmetric in orientation to the cutting insert central axis 400. It is understood that an ovoid width dimension D6 of the ovoid bottom surface 1006 and the ovoid sidewall 1002 is narrower than an ovoid length dimension D7 of the ovoid bottom surface 1006 and the ovoid sidewall 1002, wherein the width dimension D6 is measured along an X axis and the length dimension D7 is measured along a Y axis. It is further understood that the cutting insert central axis 400 and the X-axis and the Y-axis are all three mutually orthogonal.

Figure 11A:
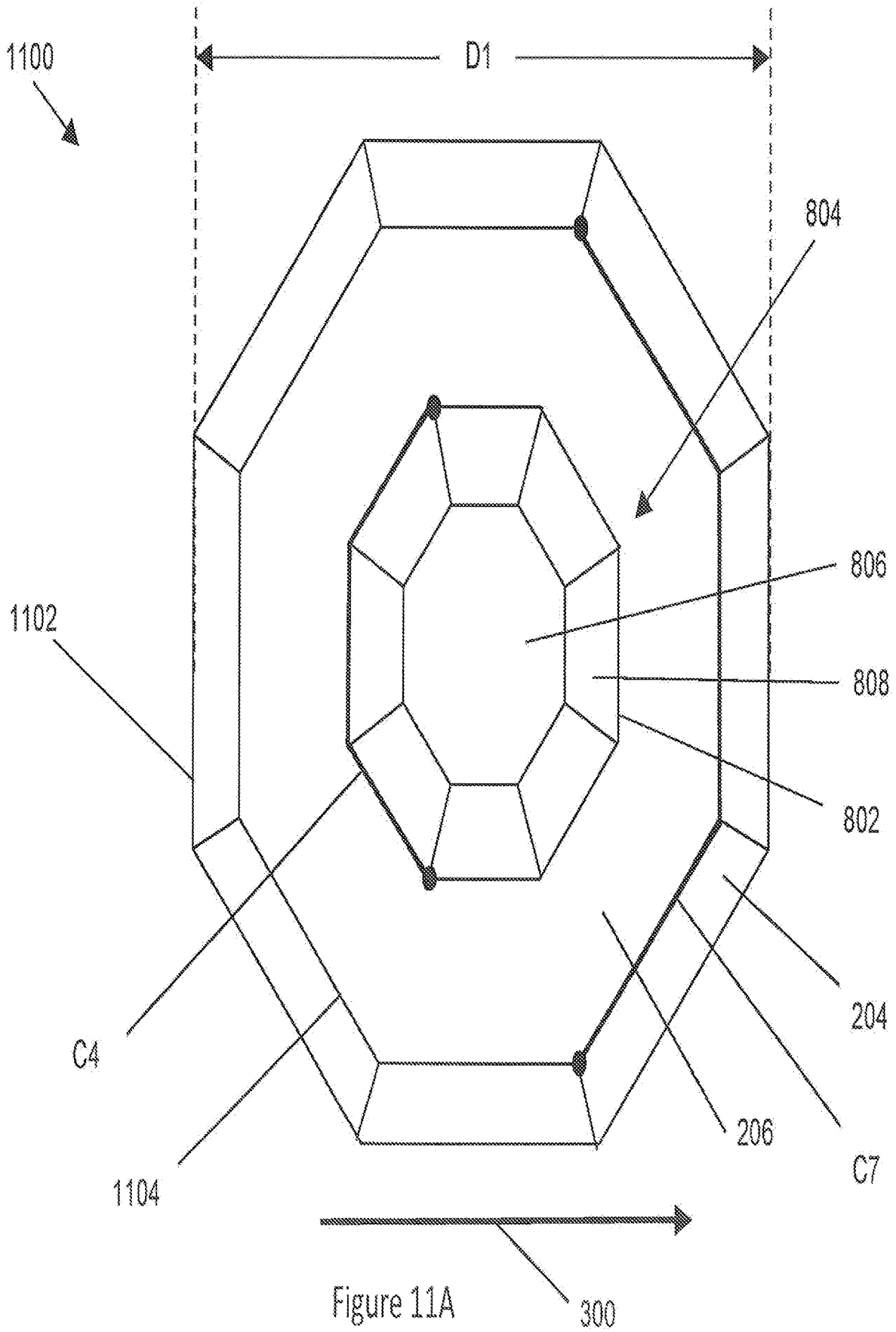
FIG. 11A is a top plan view of a second alternate octagonal embodiment of the invented cutting insert of FIG. 2B.

Referring now generally to the Figures and particularly FIG. 11A, FIG. 11A is a top plan view of second alternate octagonal embodiment of the invented cutting insert 1100 (hereinafter, "second octagonal cutting insert" 1100). The second octagonal cutting insert 1100 presents an octagonal sidewall 1102, an octagonal top outer edge 1104, and the octagonal inner top edge 802. The octagonal depression 804 of the second octagonal cutting insert 1100 includes the octagonal depression surface 806 and the octagonal depression wall 808. The octagonal depression wall 808 extends from the octagonal inner top edge 802 to the octagonal depression surface 806. The top surface 206 extends from, and is positioned between, the octagonal inner top edge 802 and the octagonal top outer edge 1114.

When the reamer 10 is in rotational motion and traversing in the indicated angular direction 300, an octagonal outer cutting edge C7 of the octagonal top outer edge 1104 and the octagonal inner cutting edge C4 of the octagonal inner top edge 802 make contact with the sides of the borehole. In other words, the octagonal outer cutting edge C7 of the octagonal top outer edge 1114 is defined as that portion of the octagonal top outer edge 1114 that makes contact with the borehole and cuts away rock and components of the borehole as the reamer 10 is rotated within the borehole and about the central elongate axis 29. When wear occurs on the octagonal inner cutting edge C4, the resultant wear of the second octagonal cutting insert 1100 mostly or preferably exclusively cuts into the top surface 206, rather than increasing the size of the octagonal depression 804.

Figure 11B:
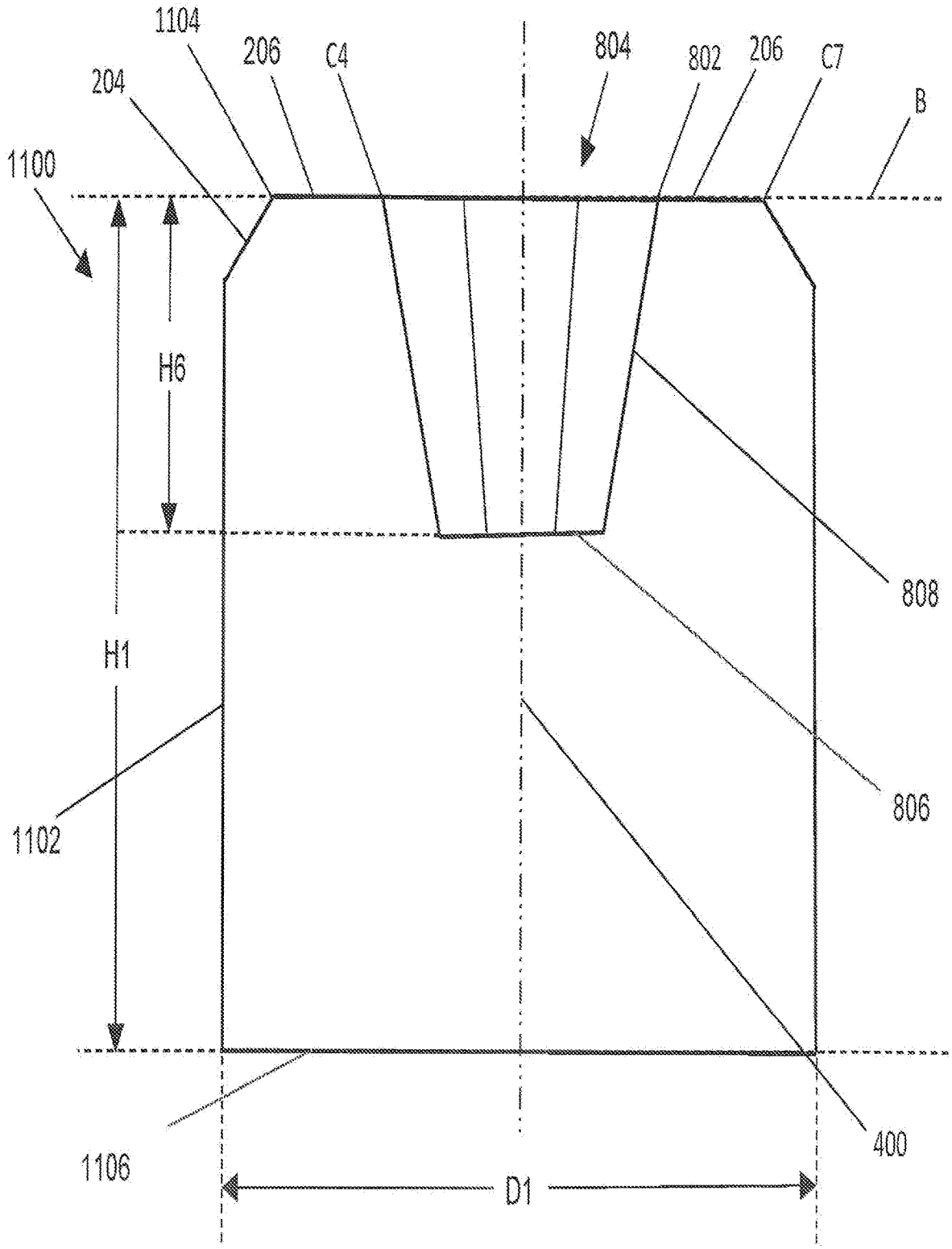
FIG. 11B is a side elevation view of the second alternate octagonal embodiment of the invented cutting insert of FIG. 8B.

Regarding FIG. 11B, FIG. 11B is a side elevation view of the second octagonal cutting insert 1100, showing a plurality of dimensions according to which the second octagonal cutting insert 1100 may preferably be built.

The first height H1 of the octagonal sidewall 1102 of the second octagonal cutting insert 1100 concentric to a cutting insert central axis 400 extending between the top surface 206 of the second octagonal cutting insert 1100 and an octagonal bottom surface 1106 of the octagonal cutting second octagonal cutting insert 1100, wherein the first height H1 is preferably within the range of from 0.01 inch to 5.0 inches or greater and more preferably within the range of 1⅜ inches to 2¼ inches. A sixth height H6 represents a depth of the octagonal depression 804 extending along the cutting insert central axis 400 from the location of the octagonal inner top edge 802 and the octagonal depression bottom surface 806. FIG. 11B further illustrates the octagonal depression wall 808 extending from the octagonal inner top edge 802 to the octagonal depression bottom surface 806.

It is understood that the octagonal top outer edge 1104, the octagonal inner top edge 802 and/or the octagonal depression 804 may be approximately or substantively axi-symmetric in orientation to the cutting insert central 400.

Figure 12A:
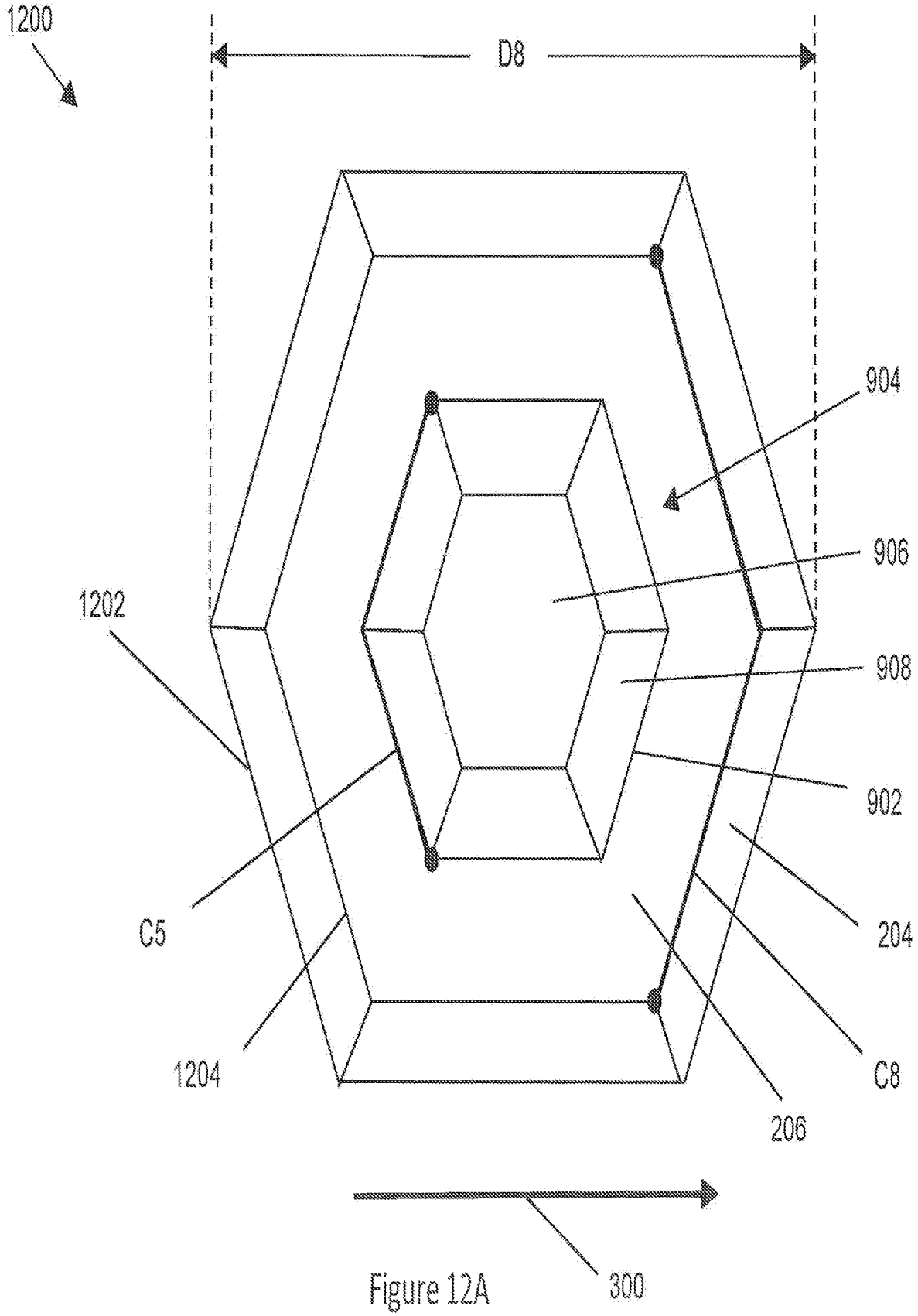
FIG. 12A is a top plan view of a second alternate hexagonal embodiment of the invented cutting insert of FIG. 2B.

Referring now generally to the Figures and particularly FIG. 12A, FIG. 12A is a top plan view of a second alternate hexagonal embodiment of the invented cutting insert 1200 (hereinafter, "second hexagonal cutting insert" 1200). The second hexagonal cutting insert 1200 presents an hexagonal sidewall 1202, an hexagonal top outer edge 1204, and the hexagonal inner top edge 902. The hexagonal depression 904 of the second hexagonal cutting insert 1200 includes the hexagonal depression surface 906 and the hexagonal depression wall 908. The hexagonal depression wall 908 extends from the hexagonal inner top edge 902 to the hexagonal depression surface 906. The top surface 206 extends from, and is positioned between, the hexagonal inner top edge 902 and the hexagonal top outer edge 1204.

When the reamer 10 is in rotational motion and traversing in the indicated angular direction 300, the hexagonal outer cutting edge C8 of the hexagonal top outer edge 1204 and the hexagonal inner cutting edge C5 of the hexagonal inner top edge 902 make contact with the sides of the borehole. In other words, the hexagonal outer cutting edge C8 of the hexagonal top outer edge 1204 is defined as that portion of the hexagonal top outer edge 1204 that makes contact with the borehole and cuts away rock and components of the borehole as the reamer 10 is rotated within the borehole and about the central elongate axis 29. When wear occurs on the hexagonal inner cutting edge C5, the resultant wear of the second hexagonal cutting insert 1200 mostly or preferably exclusively cuts into the top surface 206, rather than increasing the size of the hexagonal depression 904. It is understood that the hexagonal inner top edge 902 and/or the hexagonal depression 904 may be approximately or substantively axi-symmetric in orientation to the cutting insert central 400.

Figure 12B:
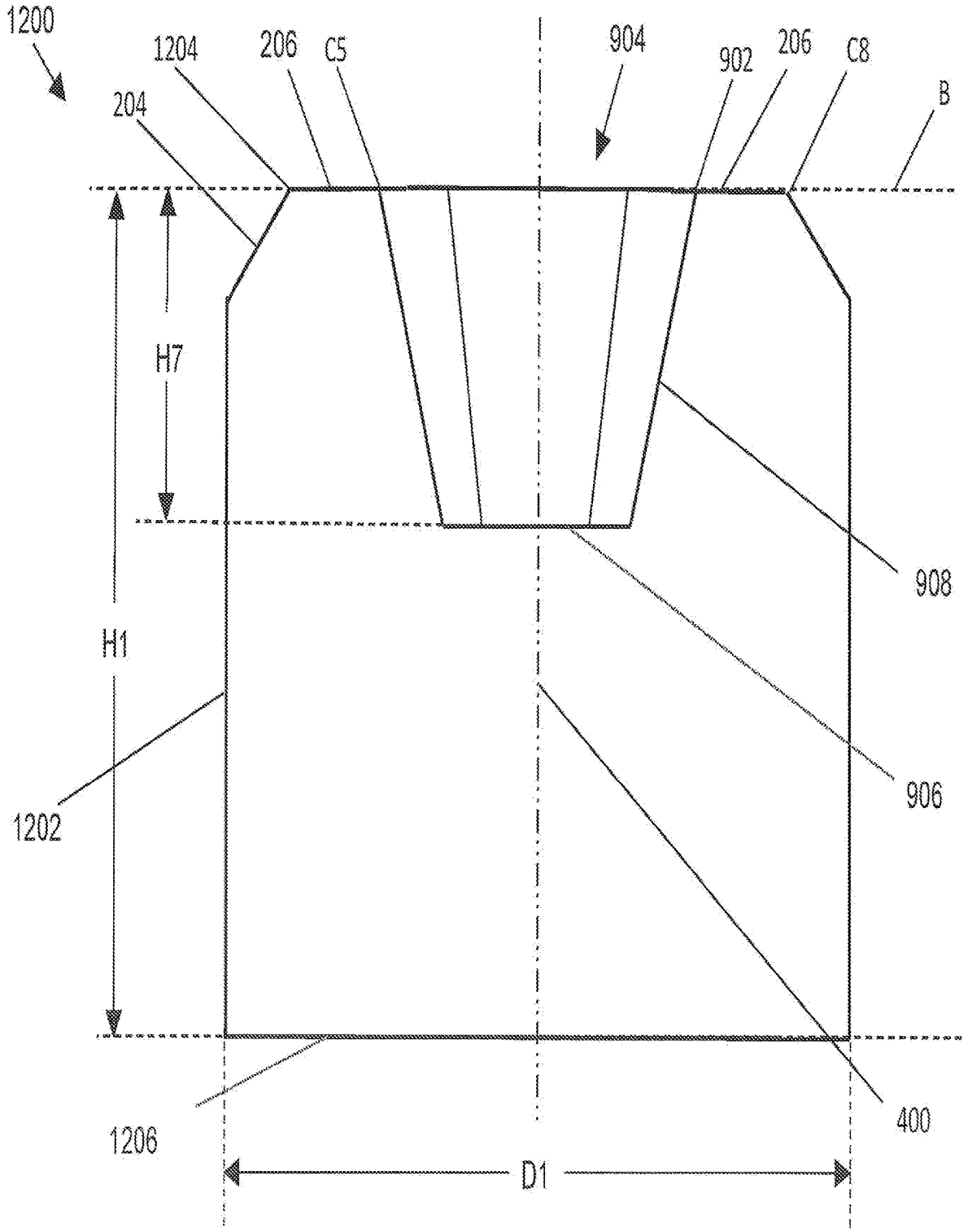
FIG. 12B is a side elevation view of the second alternate hexagonal embodiment of the invented cutting insert of FIG. 2B.

Regarding FIG. 12B, FIG. 12B is a side elevation view of the second hexagonal cutting insert 1200, showing a plurality of dimensions according to which the second hexagonal cutting insert 1200 may preferably be built.

The first height H1 of the hexagonal sidewall 1202 of the second hexagonal cutting insert 1200 concentric to a cutting insert central axis 400 extending between the top surface 206 of the second hexagonal cutting insert 1200 and an hexagonal bottom surface 1206 of the second hexagonal cutting insert 1200, wherein the first height H1 is preferably within the range of from 0.01 inch to 5.0 inches or greater and more preferably within the range of 1⅜ inches to 2¼ inches. A seventh height H7 represents a depth of the hexagonal depression 904 extending along the cutting insert central axis 400 from the location of the hexagonal inner top edge 902 and the hexagonal depression bottom surface 906. FIG. 12B further illustrates the hexagonal depression wall 908 extending from the hexagonal inner top edge 902 to the hexagonal depression bottom surface 906.

It is understood that in various alternate preferred embodiments of the present invention, the cutting insert sidewall 210,1102 & 1202, the outer top edge 214, 1104 & 1204, and/or the inner top edge 216, 802 & 902 may be formed as a suitable polygon shape known in the art.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Additionally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based herein. Accordingly, the disclosure of the embodiments of the invention is intended to be illustrative, but not limiting, of the scope of the invention, which is set forth in the following claims.

What is claimed is:

1. A cutting insert for coupling with a reamer, the cutting insert comprising:

a unitary structure forming an exposed planar top side, an attachment side and a sidewall, whereby when the cutting insert is coupled to a reamer and the top side is exposed and positioned to cut against a borehole wall, a substantial shear force is experienced by the cutting insert when the cutting insert is separating material from the borehole wall;

the attachment side adapted for insertion into a reamer and the attachment side is further adapted to enable positioning of the planar top side parallel to a central elongate axis of the reamer;

the sidewall extending axially from the attachment side to the insert top side and along a sidewall diameter extending parallel to the top side and radially from and perpendicular to a central axis of the cutting insert to an outside maximum radius of the cutting insert, the sidewall having a depth extending from the top side and to the attachment side, and the sidewall adapted for at least partial insertion into the reamer; and the top side comprising an outer cutting edge, wherein the outer cutting edge is circular or axi-symmetric to the cutting insert central axis, an inner cutting edge, wherein the inner cutting edge is circular or axi-symmetric to the cutting insert central axis, and a depression, the depression having a maximum radial distance parallel to the top side and extending orthogonally from the cutting insert central axis in the range of from at least 30% to no greater than 90% of the outside maximum radius of the cutting insert, and the depression extending away from the top side and toward the attachment side along the cutting insert central axis for in the range of from ⅛ inch to ¾ inch.

2. The cutting insert of claim 1, wherein the outer cutting edge is a closed polygon axi-symmetric and normal to a cutting insert central axis.

3. The cutting insert of claim 1, wherein the depression further comprises a cylindrical section.

4. The cutting insert of claim 1, wherein the width of the depression extends from the cutting insert central axis to a radius no greater than ⅔ of the outside maximum radius of the cutting insert.

5. The cutting insert of claim 1, wherein a conical section of the depression extends along a cutting insert central axis to a depth of at least ½ fraction of a maximal height of the sidewall ending in a cylindrical section.

6. The cutting insert of claim 1, wherein the cutting insert comprises a metal matrix composite.

7. The cutting insert of claim 1, wherein the cutting insert comprises a tungsten carbide compound.

8. The cutting insert of claim 1, wherein the cutting insert is a homogeneous unitary structure.

9. The cutting insert of claim 1, wherein the central axis of the cutting insert is perpendicular to the central elongate axis of the reamer.

10. A cutting insert for coupling with a reamer, the cutting insert comprising:

a unitary structure forming an exposed planar top side, an attachment side and a sidewall, whereby when the cutting insert is coupled to a reamer and the top side is exposed and positioned to cut against a borehole wall, a substantial shear force is experienced by the cutting insert when the cutting insert is separating material from the borehole wall;

the attachment side adapted for insertion into a reamer, and the attachment side is further adapted to enable positioning of the planar top side parallel to a central elongate axis of the reamer;

the sidewall extending axially from the attachment side to the insert top side and along a sidewall diameter extending parallel to the top side and radially from and perpendicular to a central axis of the cutting insert to an outside maximum radius of the cutting insert, the sidewall having a depth extending from the top side and to the attachment side, and the sidewall adapted for at least partial insertion into the reamer; and the planar top side comprising an outer cutting edge wherein the outer cutting edge is circular or axi-symmetric to the cutting insert central axis, an inner cutting edge wherein the inner cutting edge is circular or axi-symmetric to the cutting insert central axis, and a depression, the depression having a maximum radial distance parallel to the top side and extending from the top side inner cutting edge and toward the attachment side, and the depression maximum radial distance extending for less than ½ of the outside maximum radius of the cutting insert, wherein the depression extends along the central axis of the cutting insert from the top side to a depth of in the range of from ⅛ inch to ¾ inch.

11. The cutting insert of claim 10, wherein the depression comprises a cylindrical section that extends from the top side along the cutting insert central axis.

12. The cutting insert of claim 10, wherein the cutting insert comprises tungsten carbide.

13. The cutting insert of claim 10, wherein the planar top side extends toward the cutting insert central axis from the outer cutting edge to the inner cutting edge.

14. The cutting insert of claim 13, wherein the planar top surface extends along a plane substantively normal to the cutting insert central axis.

15. The cutting insert of claim 14, wherein an axisymmetric external surface about the cutting insert central axis of the co-centric depression is cylindrical.

16. The cutting insert of claim 14, wherein the outer cutting edge is circular.

17. The cutting insert of claim 16, wherein the inner cutting edge is circular.

18. The cutting insert of claim 17, wherein the perimeter of the depression is circular.

19. The cutting insert of claim 10, wherein the cutting insert is a homogeneous unitary structure.

20. The cutting insert of claim 10, wherein the central axis of the cutting insert is perpendicular to a central elongate axis of the reamer.

21. The cutting insert of claim 10, wherein the inner cutting edge is circular or axi-symmetric to the cutting insert central axis.

22. The cutting insert of claim 10, wherein the outer cutting edge is circular or axi-symmetric to the cutting insert central axis.

* * * * *